US012629583B2

(12) United States Patent
Amanna

(10) Patent No.: US 12,629,583 B2
(45) Date of Patent: May 19, 2026

(54) BOXING GLOVE

(71) Applicant: Boxraw Ltd, Coventry (GB)

(72) Inventor: Benjamin Amanna, Coventry (GB)

(73) Assignee: Boxraw Ltd., Coventry (GB)

( * ) Notice: Subject to any disclaimer, the term of this patent is extended or adjusted under 35 U.S.C. 154(b) by 0 days.

(21) Appl. No.: 18/719,817

(22) PCT Filed: Dec. 16, 2022

(86) PCT No.: PCT/GB2022/053259

§ 371 (c)(1),
(2) Date: Jun. 13, 2024

(87) PCT Pub. No.: WO2023/111582

PCT Pub. Date: Jun. 22, 2023

(65) Prior Publication Data

US 2025/0050191 A1 Feb. 13, 2025

(30) Foreign Application Priority Data

Dec. 16, 2021 (GB) ..... 2118240

(51) Int. Cl.

| | |
|---|---|
| ***A63B 71/14*** | (2006.01) |
| *A41D 13/08* | (2006.01) |
| *A41D 19/015* | (2006.01) |

(52) U.S. Cl.

CPC ..... *A63B 71/145* (2013.01); *A41D 13/08* (2013.01); *A41D 13/081* (2013.01);
(Continued)

(58) Field of Classification Search

CPC ..... A41D 13/08; A41D 13/081; A41D 19/01582; A41D 19/01523; A41D 19/015;
(Continued)

(56) References Cited

U.S. PATENT DOCUMENTS 5,197,149 A * 3/1993 Overton ..... A41D 19/01582 2/161.4
7,908,672 B2 * 3/2011 Butler ..... A63B 21/0605 2/162

(Continued)

FOREIGN PATENT DOCUMENTS

| | | |
|---|---|---|
| JP | 3166611 | 2/2011 |
| KR | 1020060122295 | 11/2006 |
| WO | 2011/006053 | 1/2011 |

OTHER PUBLICATIONS

International Search Report and Written Opinion of the International Searching Authority from a corresponding International patent application (PCT/GB2022/053259) bearing a mailing date of Apr. 26, 2023.
UKIPO Search Report from a corresponding GB patent application (GB 2118240.7) bearing a mailing date of May 23, 2022.

*Primary Examiner* — Khaled Annis
*Assistant Examiner* — Dakota Marin
(74) *Attorney, Agent, or Firm* — Brown & Brown IP Law PLLC

(57) ABSTRACT

A boxing glove (2) comprises a hand portion (4) for receiving a wearer's hand: a cuff portion (6) for receiving the wearer's wrist and a part of the wearer's forearm: a wrist strap (90) attached to and extending from the cuff portion, the wrist strap configured to extend around the cuff portion and including a first securing element (88*a*): a cuff strap (70) attached to and extending from the cuff portion, the cuff strap including a second securing element (88*b*), the first securing element being configured to engage with the second securing element; and a third securing element (106) disposed on a part of the cuff portion, the second securing element being configured to engage with the third securing element. In use, the first securing element is engaged with a part of the second securing element, the cuff strap is wrapped around the cuff portion, and a part of the second
(Continued)

securing element is engaged with the third securing element. Engaging the second securing element with the third securing element simultaneously tightens the wrist strap and the cuff strap around the cuff portion.

20 Claims, 14 Drawing Sheets

(52) U.S. Cl.
CPC ..... *A41D 19/015* (2013.01); *A41D 19/01523* (2013.01); *A41D 19/01582* (2013.01); *A63B 71/14* (2013.01); *A63B 2209/10* (2013.01); *A63B 2244/102* (2013.01)

(58) Field of Classification Search
CPC . A63B 71/145; A63B 71/14; A63B 2244/102; A63B 2209/10
USPC ..... 2/18
See application file for complete search history.

(56) References Cited

U.S. PATENT DOCUMENTS

| | | | | |
|---|---|---|---|---|
| 8,646,113 | B2 * | 2/2014 | Clement | A41F 1/06 2/161.1 |
| 9,079,093 | B2 * | 7/2015 | Clement | A63B 71/145 |
| 9,480,902 | B2 * | 11/2016 | House | A63B 71/141 |
| 9,545,126 | B2 * | 1/2017 | Bisaillon | A41D 19/01523 |
| 10,004,975 | B2 * | 6/2018 | Clement | A63B 71/145 |
| 10,376,770 | B2 * | 8/2019 | Wittman | A63B 71/145 |
| 11,344,788 | B1 * | 5/2022 | Wittman | A63B 71/145 |
| 12,172,068 | B2 * | 12/2024 | Amanna | A63B 71/14 |
| 2013/0000006 | A1 * | 1/2013 | Norton | A41F 1/06 2/16 |
| 2016/0000006 | A1 | 1/2016 | Drake et al. | |
| 2016/0051883 | A1 * | 2/2016 | Clement | A63B 71/145 2/161.1 |
| 2016/0367881 | A1 * | 12/2016 | Le | A41F 1/06 |

* cited by examiner

BOXING GLOVE

FIELD OF THE INVENTION

This invention relates to the field of boxing gloves.

BACKGROUND TO THE INVENTION

Boxing gloves are cushioned gloves that are worn by boxers to protect both the wearer's hands and their opponent's body, in particular their opponent's head. Boxing gloves are typically worn over hand wraps. The hand wraps offer additional protection for the wearer's hands, in particular helping to stabilise the first area against injuries.

There are a number of different types of glove and, in particular, a boxer may wear different gloves during practice sessions and training, and during competitions and professional matches. Each of the different types of glove may have different levels of padding, and those gloves worn during competitions must be constructed according to official regulations.

One difference between boxing gloves is the method of securing the gloves to a wearer's hands. Some boxing gloves are of a traditional lace-up style, while the majority of boxing gloves, certainly for training purposes, are secured using hook and loop material (Velcro™). The benefit of lace-up gloves is that the lacing can provide a very good fit of the glove over the wrist and lower arm of the wearer. They do, however, usually require a second person to lace them up, and can be slower to put on and take off. Lace up gloves are the preferred form of boxing glove for professional boxers. Velcro™ boxing gloves have the advantage that the boxer can put them on and take them off by themselves. For this reason Velcro™ boxing gloves are often used for training and practice sessions. While the thick Velcro™ strap can also provide some additional support around the wearer's wrist, these gloves traditionally have slightly less padding around the wrist then lace up gloves. Furthermore, the support around the wearer's wrist is generally reduced compared with lace up gloves.

It is common for a beginner to start with Velcro™ gloves and then progress to lace up gloves at a later stage to obtain the better fit and wrist support. In many cases it is beneficial to buy both types of glove so that the boxer can use the Velcro™ gloves for quick training sessions and the lace up gloves for longer gym-based training sessions and competitions.

Against this background it is desirable to provide a boxing glove that has an improved fit around the wearer's wrist and forearm, thereby providing improved support in this region, but which is easy to put on and take off, and which preferably does not require a second person to assist with the putting on and taking off of the gloves.

SUMMARY OF THE INVENTION

One aspect of the disclosure provides a boxing glove comprising:

- a hand portion for receiving the fingers and palm of a wearer's hand; and
- a thumb portion for receiving the wearer's thumb, the thumb portion comprising an internal thumb pocket for receiving a wearer's thumb, a width of the internal thumb pocket being substantially smaller than an external width of the thumb portion.

The width of the internal thumb pocket may be no greater than 75% of the external width of the thumb portion. The width of the internal thumb pocket is preferably no greater than 65% of the external width of the thumb portion, and may be about 60% of the external width of the thumb portion. In some examples the internal thumb pocket is closer to an outer edge of the thumb portion furthest from the hand portion than to an inner edge of the thumb portion adjacent the hand portion. In other embodiments the internal thumb pocket is disposed substantially midway across the external width of the thumb portion. The thumb portion may comprise an outer layer and an inner layer. The thumb pocket may, therefore, be formed by the inner layer and not the outer layer, and the inner layer may be secured to the outer layer to maintain the position of the thumb pocket relative to the outer layer.

Another aspect of the disclosure provides a boxing glove comprising:

- a hand portion for receiving a wearer's hand;
- a cuff portion for receiving the wearer's wrist and a part of the wearer's forearm;
- a wrist strap attached to and extending from the cuff portion, the wrist strap configured to extend around the cuff portion and including a first securing element;
- a cuff strap attached to and extending from the cuff portion, the cuff strap including a second securing element, the first securing element being configured to engage with the second securing element; and
- a third securing element disposed on a part of the cuff portion, the second securing element being configured to engage with the third securing element; and
- wherein, in use, the first securing element is engaged with a part of the second securing element, the cuff strap is wrapped around the cuff portion, and a part of the second securing element is engaged with the third securing element, and wherein engaging the second securing element with the third securing element simultaneously tightens the wrist strap and the cuff strap around the cuff portion.

The boxing glove may further comprise a guide element. The wrist strap may be looped around the guide element when the cuff strap is wrapped around the cuff portion. The guide element is preferably in the form of a buckle loop through which the wrist strap extends when the first securing element is engaged with the second securing element. The guide element may be secured to an end of the wrist strap. The guide element may be secured to the cuff portion.

A length of the cuff portion may be defined between the hand portion and an end edge of the cuff portion. In some examples a width of the wrist strap in a direction parallel to the length of the cuff portion is substantially less than the length of the cuff portion. The width of the wrist strap may be less than half the length of the cuff portion. In preferred examples the wrist strap is adjacent the hand portion. In some examples a width of the cuff strap in a direction parallel to the length of the cuff portion is equal to the length of the cuff portion.

The wrist strap may form a complete loop around the cuff portion when the second securing element is engaged with the third securing element. The first securing element may be disposed at an end of the wrist strap and the second securing element may be disposed at an end of the cuff strap.

The third securing element may be disposed on a dorsal section of the cuff portion arranged to extend over a back of the wearer's wrist. In some examples the wrist strap extends through a channel between a part of the third securing element and the dorsal section of the cuff portion.

Each of the first securing element, second securing element and third securing element may comprise one of hook and loop material. In some examples, when the second securing element is engaged with the third securing element more than 50% of the wrist strap is covered by the cuff strap. In some examples the boxing glove may comprise two or more wrist straps, the wrist straps being spaced along the length of the cuff portion defined between the hand portion and an end edge of the cuff portion. The second securing element may include indicia indicating a distance from an end of the cuff strap adjacent the second securing element.

A further aspect of the disclosure provides a method of putting on a boxing glove comprising:

inserting a hand into a hand portion of the glove such that a cuff portion of the glove extends around a wrist and a part of a forearm;

engaging a first securing element of a wrist strap to a second securing element of a cuff strap, the wrist strap attached to and extending from the cuff portion, the wrist strap configured to extend around the cuff portion;

after engaging the first securing element of the wrist strap to the second securing element of the cuff strap, wrapping the cuff strap around the cuff portion;

after wrapping the cuff strap around the cuff portion, engaging the second securing element to a third securing element disposed on a part of the cuff portion, to simultaneously tighten the wrist strap and the cuff strap around the cuff portion.

An aspect of the disclosure provides a boxing glove comprising:

a hand portion for receiving a wearer's hand, the hand portion including a first portion for receiving the wearer's fingers, a thumb portion for receiving the wearer's thumb, a palm region arranged to extend over the wearer's palm and a back region arranged to extend over the back of the wearer's hand;

a cuff portion for receiving the wearer's wrist and a part of the wearer's forearm, the cuff portion extending from the hand portion and terminating at an end edge furthest from the hand portion; and a grip bar extending transversely across the palm region of the hand portion between first and second ends, the first end of the grip bar being adjacent an index edge of the palm region adjacent the thumb portion and the second end of the grip bar being adjacent an opposite outer edge of the palm region, and at least a part of the first end of the grip bar being further from the end edge of the cuff portion than at least a part of the second end of the grip bar.

The grip bar may comprise a first elongate edge and an opposite second elongate edge, each of the elongate edges extending between the first and second ends, the first elongate edge being disposed closer to the cuff portion than the second elongate edge, and the second elongate edge being curved. The second elongate edge may have a concave curvature.

In some examples the grip bar comprises a first end edge at the first end of the grip bar and a second end edge at the second end of the grip bar, and a length of the first end edge is smaller than a length of the second end edge. In some examples the grip bar may be curved along an axis of the grip bar extending between the first and second ends. An angle between the end edge of the cuff portion and an axis of the grip bar extending between the first and second ends may be greater than 20°. The angle between the end edge of the cuff portion and the axis of the grip bar may be greater than 30°. In some examples the grip bar is disposed between an outer layer of the boxing glove and a lining layer of the boxing glove. The grip bar is preferably disposed between two longitudinal rows of stitching that extend along the length of the grip bar and two rows of stitching extending transverse to the longitudinal rows of stitching, the rows of stitching joining the outer layer to the lining layer thereby creating a closed pocket within which the grip bar is disposed.

In some examples the boxing glove may further comprise a curved seam between the first portion and the palm region of the hand portion. A distance between the second elongate edge and the curved seam at the first end of the grip bar may be smaller than a distance between the second elongate edge and the curved seam at the second end of the grip bar.

An aspect of the disclosure provides a boxing glove comprising:

a hand portion for receiving a wearer's hand, the hand portion including a first portion for receiving the wearer's fingers, a thumb portion for receiving the wearer's thumb, a palm region arranged to extend over the wearer's palm and a back region arranged to extend over the back of the wearer's hand;

a cuff portion for receiving the wearer's wrist and a part of the wearer's forearm, the cuff portion terminating at an end edge furthest from the hand portion, and the cuff portion including a volar section adjacent the palm region and arranged to extend over an inside of the wearer's wrist and a dorsal section adjacent the back region and arranged to extend over a back of the wearer's wrist; and a panel of padding extending through the cuff portion, the panel of padding extending in a first direction between the hand portion and the end edge and in a second direction between the volar section and the dorsal section.

A first line of stitching may extend along and adjacent a first edge of the panel of padding, between the panel of padding and the volar section, and a second line of stitching may extend along and adjacent a second edge of the panel of padding, between the panel of padding and the dorsal section.

In some examples the panel of padding may be disposed in a radial edge region of the cuff portion and extend between the thumb portion and the end edge, so that, in use, the panel of padding limits abduction of the wearer's wrist. The cuff portion of the boxing glove preferably extends from the hand portion in a length direction, and each of the volar section and the dorsal section preferably extends between a radial edge region and an ulnar edge region or the ulnar edge region. Preferably, a length of the cuff portion at the radial edge region is greater than a length of the cuff portion at the ulnar edge region. In other examples the panel of padding may be disposed in an ulnar edge region of the cuff portion, so that, in use, the panel of padding limits adduction of the wearer's wrist.

In some examples the end edge is curved between the radial edge region and the ulnar edge region, the curvature being at least partly in a plane including an axis extending parallel to the length direction. The curvature of the end edge is preferably concave.

Another aspect of the disclosure provides a boxing glove comprising:

a hand portion for receiving a wearer's hand, the hand portion including a first portion for receiving the wearer's fingers, a thumb portion for receiving the wearer's thumb, a palm region arranged to extend over the wearer's palm and a back region arranged to extend over the back of the wearer's hand;

a cuff portion for receiving the wearer's wrist and a part of the wearer's forearm, the cuff portion terminating at an end edge furthest from the hand portion, and the cuff portion including a volar section adjacent the palm region and arranged to extend over an inside of the wearer's wrist and a dorsal section adjacent the back region and arranged to extend over a back of the wearer's wrist;

a split extending from the end edge through the volar section and terminating at a closed end in the palm region, the split including two opposing edges; and a lace receiving passage connected to and extending along each of the opposing edges of the split, each lace receiving passage including a tubular portion for receiving a part of a lace therethrough, a longitudinal axis of each tubular portion extending substantially parallel to the respective edge of the split.

In some embodiments each lace receiving passage comprises an elongate tube having a first lateral side disposed adjacent the respective edge of the split and a second lateral side disposed further from said edge, and each tube includes a plurality of apertures disposed along the length of the tube through which, in use, a lace may enter and exit a bore of the tube. The apertures are preferably spaced apart along the second lateral side of the tube. The apertures of a first one of the elongate tubes are preferably aligned with the apertures of a second one of the elongate tubes.

In other examples each lace receiving passage comprises a plurality of separate tubular lugs, each tubular lug being connected to an edge of the split and an axis of each of the tubular lugs extending substantially parallel to the edge of the split to which the lug is connected. Gaps between a first set of lugs connected to a first one of the opposing edges of the split are preferably aligned with gaps between a second set of lugs connected to a second one of the opposing edges of the split.

The boxing glove may further comprise a lace received in and extending through the lace receiving passages. The lace may extend through the lace receiving passages such that the boxing glove is laced according to army-style or bow-tie lacing methods. In some examples the second lateral sides of the elongate tubes are in contact with each other when the lace is in a tightened configuration. In other examples each of the lugs of the first set of lugs is in contact with a corresponding one of the lugs of the second set of lugs when the lace is in a tightened configuration.

The boxing glove may comprise a plurality of guide channels extending across the dorsal section of the cuff portion. Preferably the boxing glove comprises at least five guide channels. At least two of the guide channels may cross to form an X-shape. Each of the guide channels may be formed by lines of stitching extending across the dorsal section of the cuff portion. Each of the guide channels preferably extends fully across the width of the dorsal section between a radial edge and an ulnar edge.

A further aspect of the disclosure provides a boxing glove comprising:

a hand portion for receiving a wearer's hand, the hand portion including a first portion for receiving the wearer's fingers, a thumb portion for receiving the wearer's thumb, a palm region arranged to extend over the wearer's palm and a back region arranged to extend over the back of the wearer's hand; and a cuff portion for receiving the wearer's wrist and a part of the wearer's forearm, the cuff portion extending from the hand portion in a length direction and terminating at an end edge furthest from the hand portion, the cuff portion including a volar section adjacent the palm region and arranged to extend over an inside of the wearer's wrist, a dorsal section adjacent the back region and arranged to extend over a back of the wearer's wrist, each of the volar section and the dorsal section extending between a radial edge region and an ulnar edge region, wherein a length of the cuff portion at the radial edge region is greater than a length of the cuff portion at the ulnar edge region.

The end edge may be curved between the radial edge region and the ulnar edge region, the curvature being at least partly in a plane including an axis extending parallel to the length direction. The curvature of the end edge may be concave.

In some examples the boxing glove further comprises a panel of padding extending through the cuff portion, the panel of padding extending in a first direction between the hand portion and the end edge and in a second direction between the volar section and the dorsal section. A first line of stitching may extend along and adjacent a first edge of the panel of padding, between the panel of padding and the volar section, and a second line of stitching may extend along and adjacent a second edge of the panel of padding, between the panel of padding and the dorsal section. The panel of padding may be disposed in a radial edge region of the cuff portion and extend between the thumb portion and the end edge, so that, in use, the panel of padding limits abduction of the wearer's wrist. In other examples the panel of padding may be disposed in an ulnar edge region of the cuff portion, so that, in use, the panel of padding limits adduction of the wearer's wrist.

A further aspect of the disclosure provides a boxing glove comprising:

a hand portion including a first portion for receiving the wearer's fingers, a palm region arranged to extend over the wearer's palm and a back region arranged to extend over the back of the wearer's hand;

a thumb portion comprising an inner panel extending generally from the palm region, and an outer panel extending generally from the back region; and a proximal thumb seam disposed between the palm region of the hand portion and the inner panel of the thumb portion to at least partially attach the thumb portion to the hand portion, the thumb seam being in the form of an open seam.

In some examples the inner panel comprises an outer layer and a lining layer, and the palm region comprises an outer layer and a lining layer. The outer layer of the inner panel may be joined to the outer layer of the palm region by an open seam, and a free edge of the outer layer of the inner panel and a free edge of the outer layer of the palm region may be disposed on an internal side of the outer layer. The lining layer of the inner panel may be joined to the lining layer of the palm region by an open seam, and a free edge of the lining layer of the inner panel and a free edge of the lining layer of the palm region may be disposed on an external side of the lining layer. At least one of the lining layers is preferably attached to at least one of the outer layers so that the free edges of both the lining layers and the outer layers are disposed between the lining layers and the outer layers.

In another aspect a boxing glove comprises a hand portion for receiving the fingers and palm of a wearer's hand; a thumb portion for receiving the wearer's thumb; and a proximal thumb seam disposed between the hand portion and the thumb portion, wherein the thumb portion is attached to the hand portion along a length of the thumb portion adjacent the proximal thumb seam and between the proximal thumb seam and a distal tip of the thumb portion.

The thumb portion may be directly attached to the hand portion such that there is no gap between a proximal region of the thumb portion adjacent the proximal thumb seam and the hand portion. In some examples there may be a gap between a distal region of the thumb portion adjacent the tip of the thumb portion and the hand portion, and in these examples the boxing glove preferably further comprises a tie strap extending between the tip of the thumb portion and the hand portion to limit separation of the tip of the thumb portion from the hand portion. Preferably the thumb portion is attached to the hand portion along at least half of the length of the thumb portion between the proximal thumb seam and the tip of the thumb portion. In some examples the thumb portion may be attached to the hand portion along the full length of the thumb portion between the proximal thumb seam and the tip of the thumb portion.

Preferred and/or optional features of each aspect and embodiment described above may also be used, alone or in appropriate combination, in the other aspects and embodiments also.

BRIEF DESCRIPTION OF THE DRAWINGS

The invention will now be further described by way of example only and with reference to the accompanying drawings, in which like reference signs are used for like features, and in which.

DESCRIPTION OF THE PREFERRED EMBODIMENTS

Figure 1:
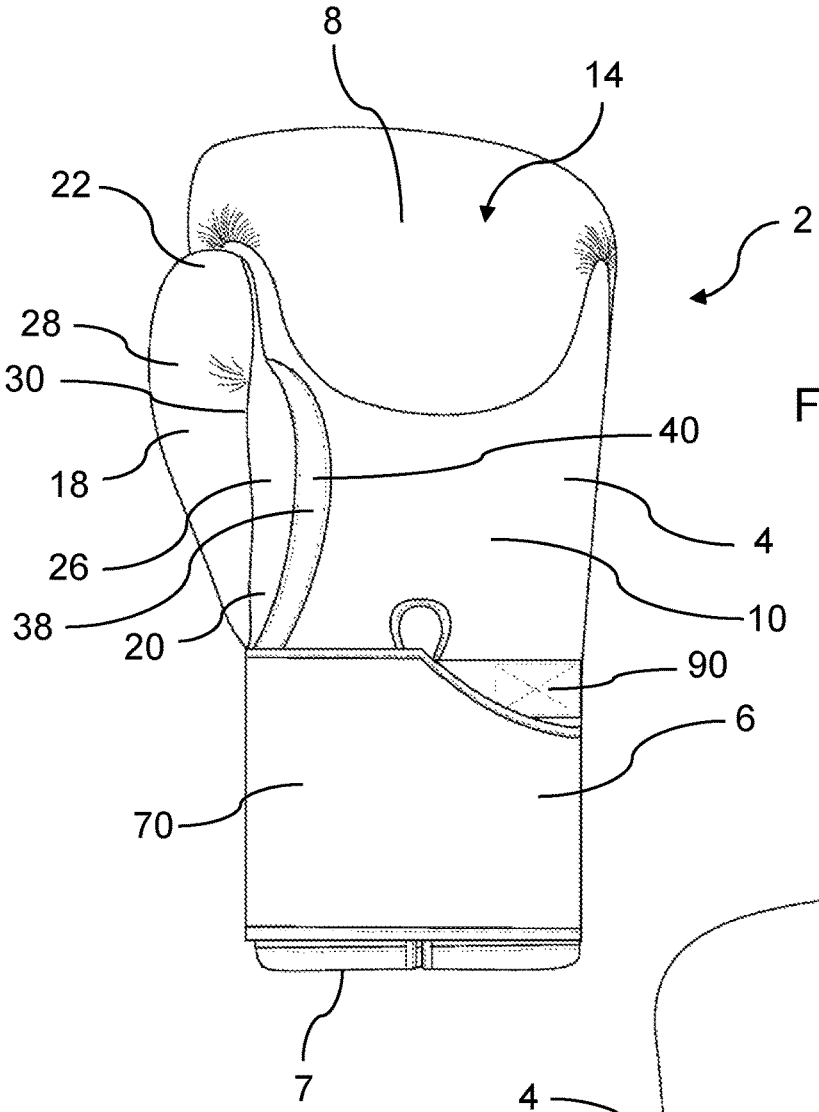
FIG. 1 is a view from a palm side of a boxing glove according to a first preferred example.
Figure 2:
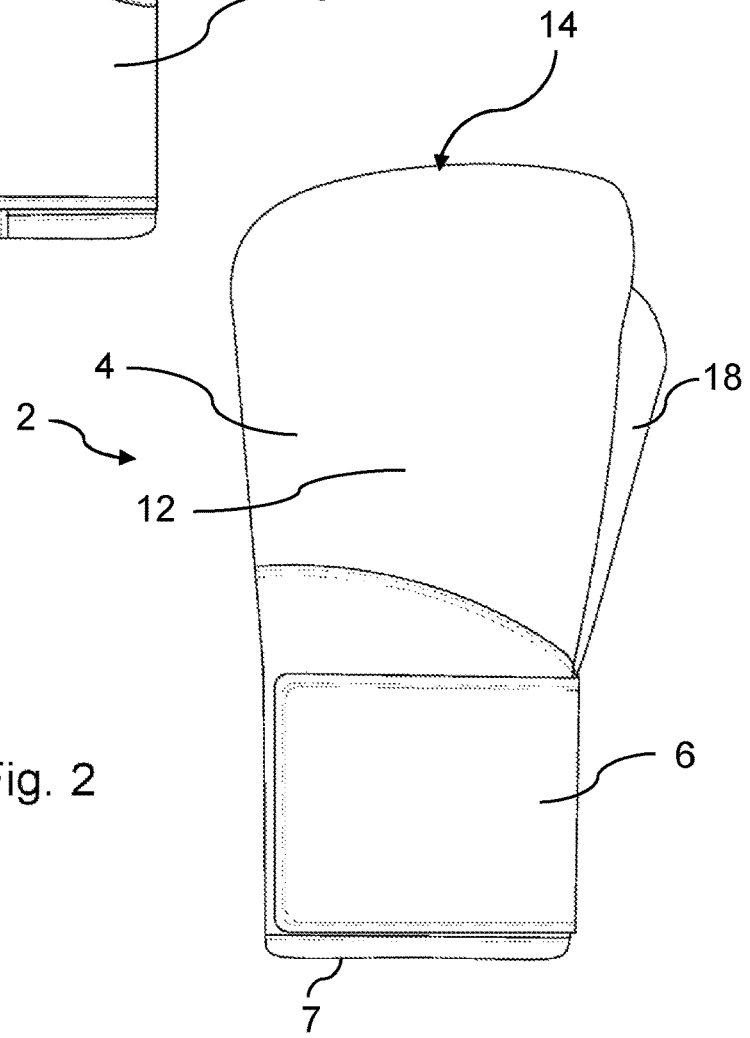
FIG. 2 is a view from a rear side of the boxing glove of FIG. 1.

FIGS. 1 to 4 illustrate a boxing glove 2 according to a first preferred example. The boxing glove 2 comprises a hand portion 4 and a cuff portion 6. In use, a boxer or wearer of the glove 2 will insert their hand into the hand portion 4 of the glove 2 and the cuff portion 6 will extend around and surround their wrist and, typically, a part of their forearm.

The hand portion 4 comprises a fist portion 8, a palm region 10 and a back region 12. With a wearer's hand correctly inserted in the hand portion 4 of the glove 2, the fist portion 8 is configured to receive the wearer's fingers, the palm region 10 extends over the wearer's palm, and the back region 12 extends over the back of the wearer's hand. The palm region 10 extends between the fist portion 8 and the cuff portion 6. The back region 12 extends between the fist portion 8 and the cuff portion 6.

An outer, striking surface 14 of the fist portion 8 extends from and is continuous with the back region 12. An inner surface 16 (shown in FIG. 7) of the fist portion 8 extends from and is continuous with the palm region 10. It will be understood that the fist portion 8 of the glove 2 is formed and shaped such that the wearer's fingers curl to form a first as they are inserted into the hand portion 4. In this way, the outer striking surface 14 has a generally convex curvature and the inner surface 16 has a generally concave curvature. As shown most clearly in FIGS. 7 and 8, there is a seam 17 between the inner surface 16 of the fist portion 8 and the palm region 10. This seam is preferably curved.

The hand portion 4 further comprises a thumb portion 18 for receiving the wearer's thumb. The thumb portion 18 has a proximal end 20 connected to and between the palm region 10 and the back region 12. The thumb portion 18 extends in a direction towards the fist portion 8 and a distal end 22 of the thumb portion 18 is disposed adjacent a first edge or index edge 24 of the first portion 8. It will be understood that the index edge 24 of the fist portion 8 is disposed adjacent to the wearer's index finger when the wearer's hand is inserted into the glove 2.

In this example the thumb portion 18 comprises an inner panel 26, extending generally from the palm region 10, and an outer panel 28, extending generally from the back region 12. An edge seam 30 extends around the thumb portion 18 and joins the inner panel 26 to the outer panel 28. The edge seam 30 comprises an outer edge section 32, a tip section 34 and an inner edge section 36. A proximal thumb seam 38 extends around the proximal end 20 of the thumb portion 18 to join the thumb portion 18 to the palm region 10 and the back region 12. A palm section 40 of the proximal thumb seam 38 extends between the inner panel 26 and the palm region 10 and a back section 42 of the proximal thumb seam 38 extends between the outer panel 28 and the back region 12.

Referring now to FIGS. 5 to 8, in this example the boxing glove 2 further comprises a tie strap 44 extending between the distal end 22 of the thumb portion 18 and the fist portion 8. The tie strap 44 preferably extends between the tip section 34 of the edge seam 30 of the thumb portion 18 and a part of the fist portion 8 at or adjacent the index edge 24. The tie strap 44 limits the distance that the distal end of the thumb portion 18 can be moved in a direction away from the fist portion 8 of the glove 2. This minimises accidental injuries to the thumb of the wearer. This feature may be known in the art as an attached thumb.

In the illustrated example the thumb portion 18 is additionally secured to the fist portion 8 along a length of the thumb portion 18. In particular, the thumb portion 18 is secured to the fist portion 8 for a distance between the proximal thumb seam 38 and the distal end 22 of the thumb portion 18. In this example, a gap 46 between the thumb portion 18 and the index edge 24 of the first portion 8, shown most clearly in FIG. 6, does not extend all the way to the proximal thumb seam 38. In this way, a first proximal section of the thumb portion 18 is secured to the fist portion 8 so that there is no gap between the thumb portion 18 and the fist portion 8, and a second distal section of the thumb portion 18 is not directly secured to the first portion so that there is a gap 46 between the thumb portion 18 and the fist portion 8. The gap 46 extends, in particular, in this example, between the tie strap 44 and an end of the proximal section of the thumb portion 18 approximately halfway along a length of the thumb portion 18.

To allow the thumb portion 18 to be secured to the fist portion 8 in this way, in this example a width of the thumb portion 18 (between the inner edge section 36 and the outer edge section 32 of the edge seam 30) is larger than in prior art boxing gloves. The width of the thumb portion 18 is enlarged to effectively fill in the gap between the thumb portion and the first portion that otherwise exists in prior art boxing gloves.

It is undesirable to change the angle at which the thumb portion 18 extends from the palm and back regions 10, 12 of the hand portion 4, as this would place a wearer's thumb in an unnatural position relative to their fingers as they form a first in the glove 2. However, it is also undesirable to allow excessive freedom of movement of a wearer's thumb inside the glove 2. This may lead to strain or injury during use of the glove 2. Accordingly, in the present example the thumb portion 18 includes an internal thumb pocket 48 indicated by the dashed lines in FIGS. 3, 4 and 5. The thumb pocket 48 is shaped and sized to receive the wearer's thumb without permitting excessive movement of the thumb. The thumb pocket 48 is disposed adjacent an outer edge of the thumb portion 18; in this example adjacent the outer edge section 32 of the edge seam 30. A width of the thumb pocket 48, in a direction parallel to the width of the thumb portion 18, is less than the width of the thumb portion 18. In this way there is an internal region of the thumb portion adjacent an inner edge of the thumb portion 18 (in this example adjacent the inner edge section 36 of the edge seam 30) that is inaccessible to any part of the wearer's hand.

It has been found that directly securing the thumb portion 18 to the fist portion 8 as described above, so as to minimise or reduce the gap 46 between the thumb portion 18 and the first portion 8, improves the aerodynamics of the glove 2. In particular the drag or air resistance on the glove 2 is reduced as it is moved through the air, for example during a punch. This allows increased acceleration of the glove through the air during a punch compared with known glove designs. This may result in a wearer or boxer being able to punch with greater force with little or no increase in effort.

Securing the thumb portion 18 to the fist portion 8 in this way also further reduces or minimises the likelihood of injury to the wearer's thumb, as there is less opportunity for the wearer's thumb to move relative to the rest of their hand once correctly positioned in the glove 2.

Figure 7:
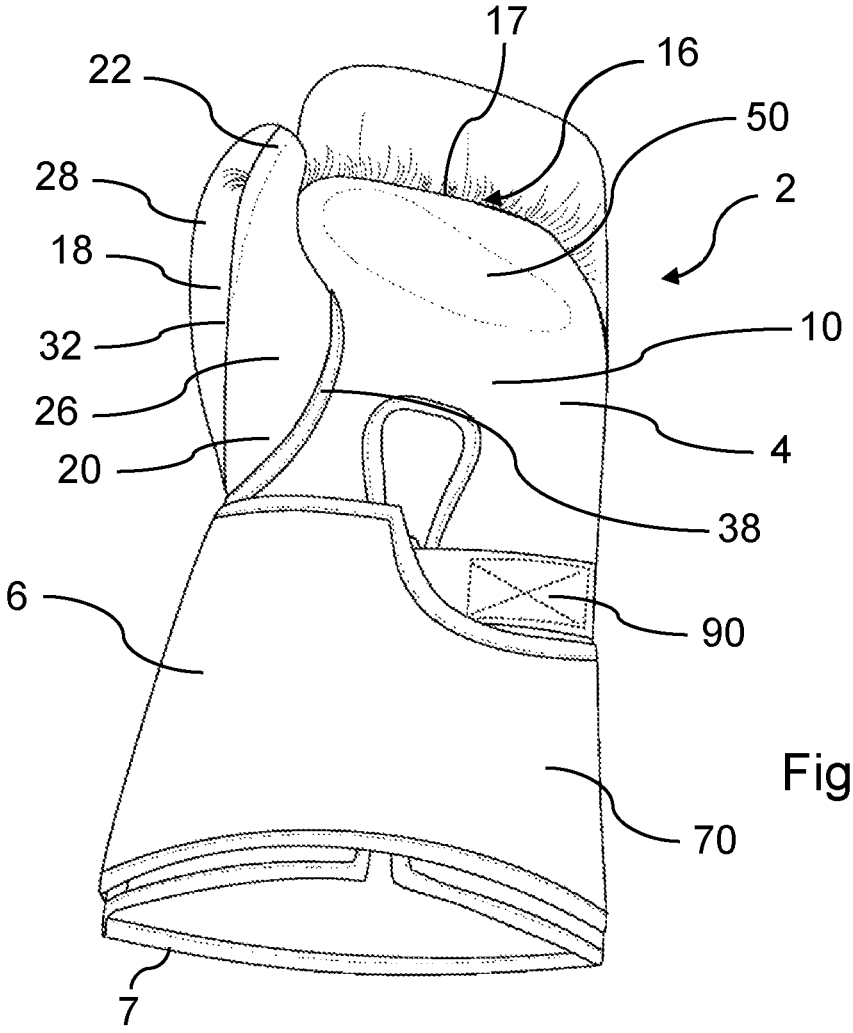
FIG. 7 is a perspective view from a lower or cuff end of the boxing glove of FIG. 1.
Figure 8:
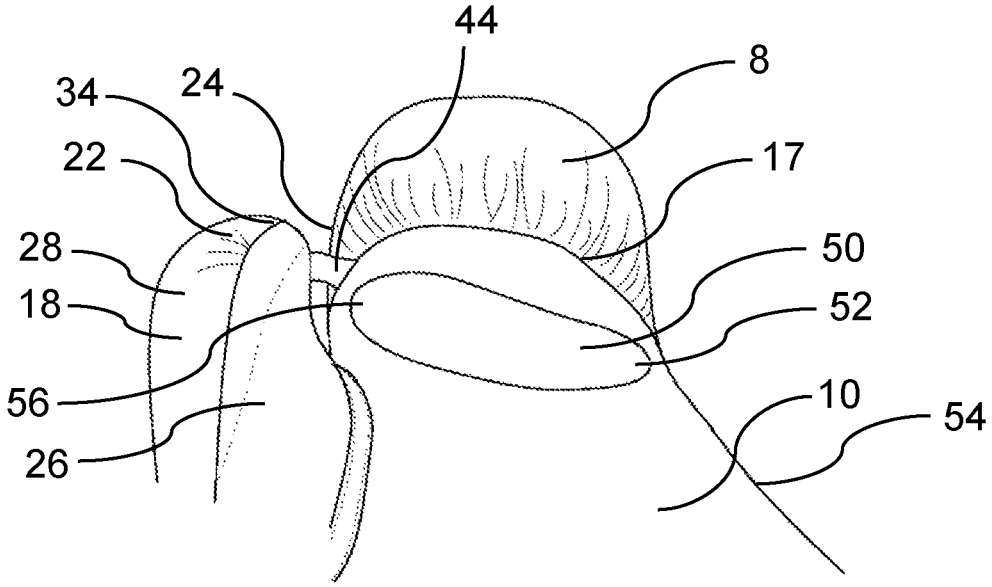
FIG. 8 is a partial view of the boxing glove of FIG. 1 showing a palm region of the glove.

Referring now to FIGS. 7 and 8, the boxing glove 2 further includes a hand bar or grip bar 50. The grip bar 50 extends transversely across the palm region 10 adjacent the fist portion 8. The grip bar 50 is elongate and extends across the palm region 10 from a first end 52 proximate an outer edge 54 of the palm region 10 to a second end 56 proximate the index edge 24 of the first portion 8. The grip bar 50 comprises a length of padding around which a wearer curls their fingers when forming a fist. The inclusion of a grip bar 50 may make it easier and more comfortable for the wearer to make a fist. The grip bar 50 is preferably made from a polymeric material in the form of a dense foam.

The grip bar 50 extends across the palm region 10 such that the second end 56 of the grip bar 50 is closer to the fist portion 8 and further from the cuff portion 6 than the first end 52 of the grip bar 50. This angling of the grip bar 50 across the palm region 10 means that when a wearer forms a fist around the grip bar 50 the base knuckles (metacarpo phalangeal joints) of their first finger and middle finger are forced further forward (in a direction away from their wrist) relative to the base knuckles of their ring finger and little finger.

In this example the grip bar 50 is curved between the first and second ends 52, 56. The grip bar 50 is curved about an axis of curvature such that a straight line extending between mid-points of the first and second ends 52, 56 of the grip bar 50 lies closer to the fist portion 8 than a central section of a curved centre-line extending along the length of the grip bar 50 between the first and second ends 52, 56. The shape of the grip bar 50, together with the curved seam between the fist portion 8 and the palm region 10, allows a wearer's fingers to form a more natural fist. In particular, this combination of features creates space for the wearer's little finger to properly grip the grip bar 50.

The cuff portion 6 of the boxing glove 2 includes a dorsal section 60 and a volar section 62. In use, the dorsal section 60 extends over and covers the rear side of a wearer's wrist and a portion of the rear side of the wearer's forearm adjacent the wrist. The volar section 62 extends over and covers the inner side of a wearer's wrist (adjacent the palm) and a portion of the inner side of the wearer's forearm adjacent the wrist. The cuff portion 6 extends to an end edge 7 of the boxing glove 2.

Figure 9:
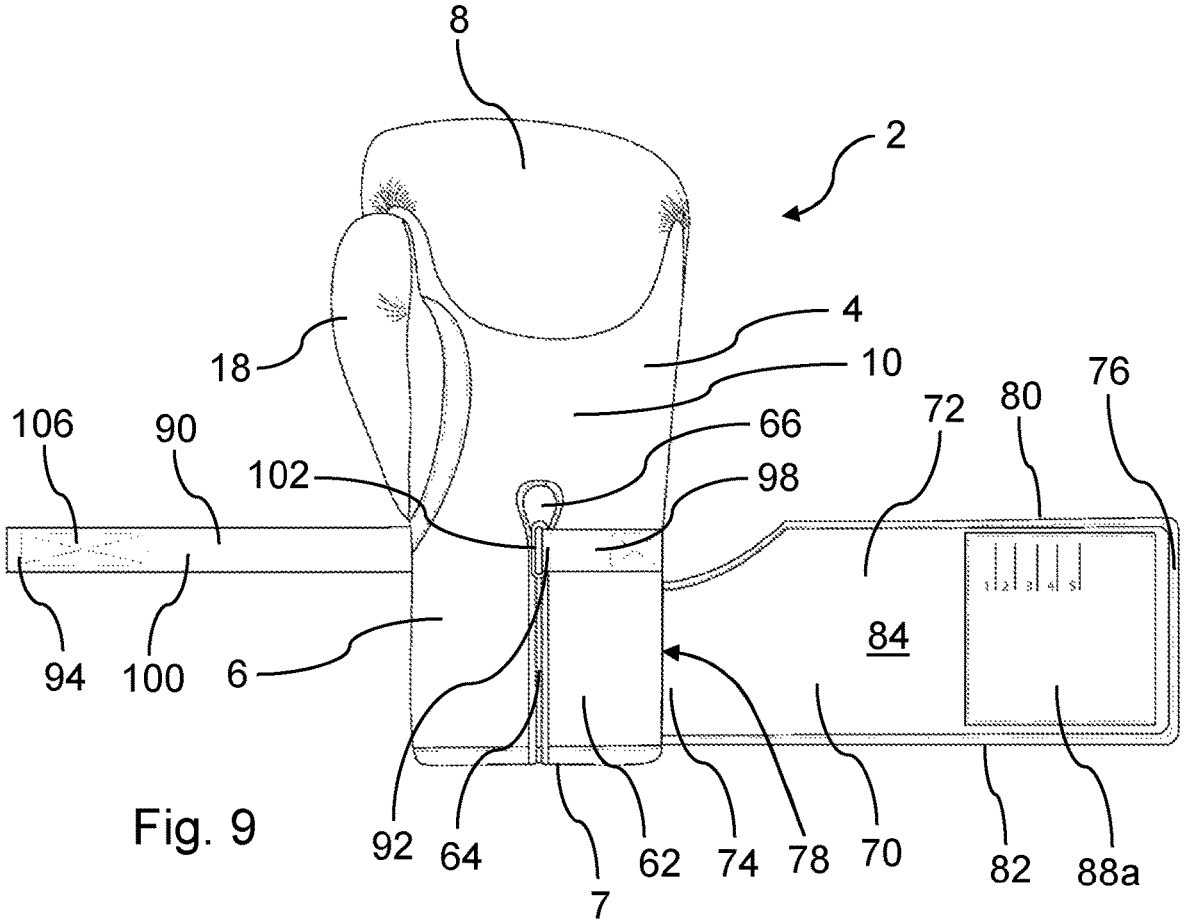
FIG. 9 is a view of the boxing glove of FIG. 1 from the palm side showing a cuff strap and a wrist strap in a fully open configuration.
Figure 10:
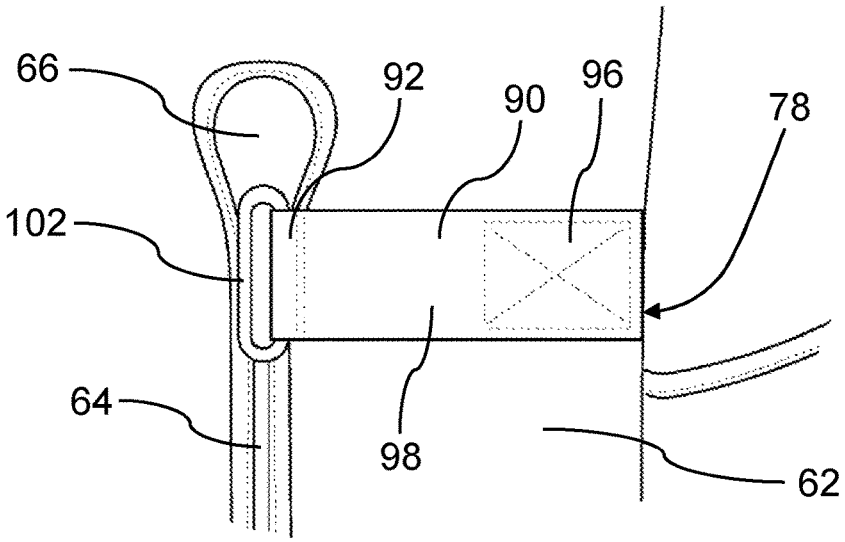
FIG. 10 is a partial view of the boxing glove of FIG. 9 showing a part of the wrist strap.
Figure 11:
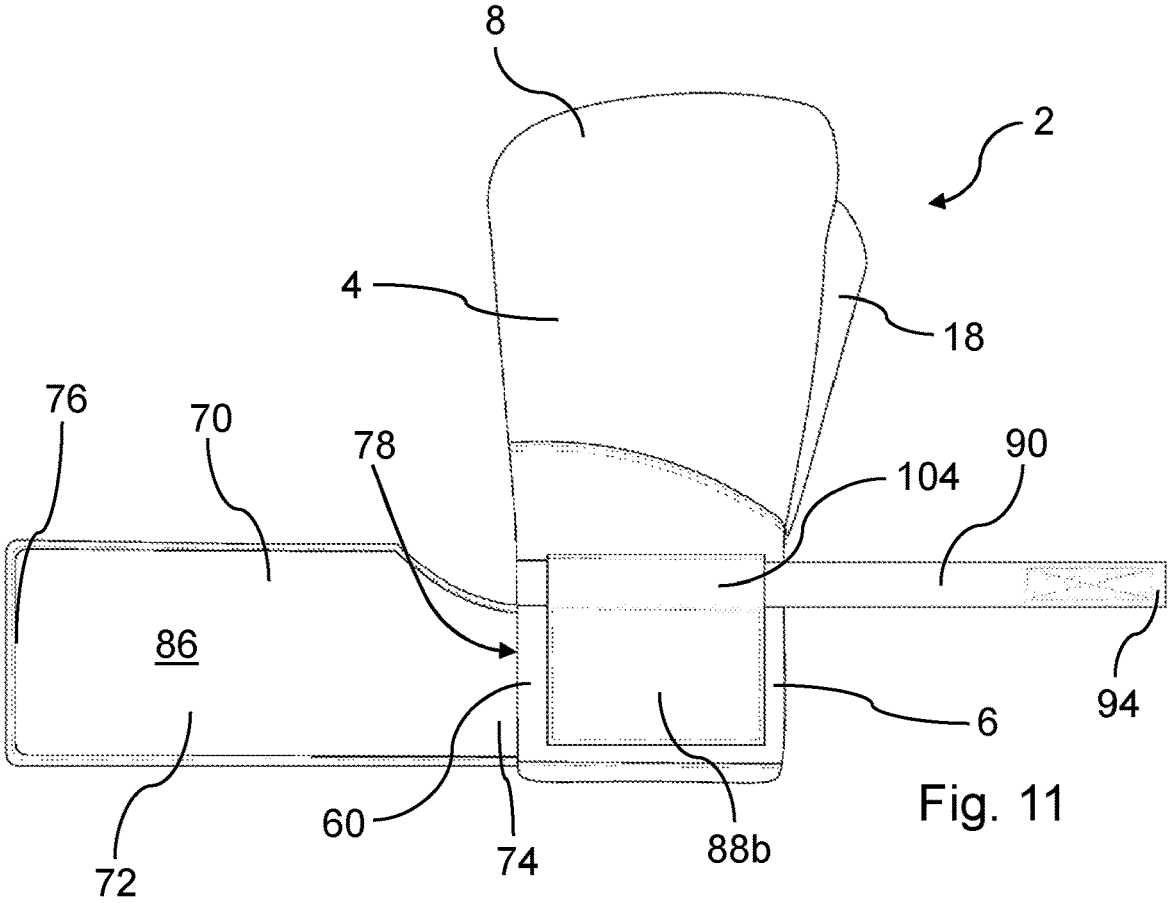
FIG. 11 is a view of the boxing glove of FIG. 9 from the rear side showing the cuff strap and the wrist strap in the fully open configuration.

The volar section 62 of the cuff portion 6, as shown most clearly in FIG. 9, includes a split 64 that allows the cuff portion 6 to be opened to allow a wearer to insert their hand into the glove 2 more easily. The split 64 also allows some overlap of the regions of the cuff portion 6 either side of the split 64 when the cuff portion 6 is secured around the wrist and forearm of the wearer as described below. The split 64 extends from the end edge 7 and terminates at a keyhole aperture 66 at a base of the palm region 10. In this example the split 64 is centrally disposed across a width of the volar section 62.

Referring now to FIGS. 9 to 16, the boxing glove 2 includes a cuff strap 70 and a wrist strap 90. The cuff strap 70 comprises a panel 72 extending between a proximal end 74 and an opposite distal end 76. A length of the cuff strap 70 is defined between the proximal end 74 and the distal end 76. The proximal end 74 is attached to an outer or ulnar edge 78 of the cuff portion 6. A width of the cuff strap 70, extending generally perpendicular to the length, is defined between opposite first and second side edges 80, 82. The cuff strap 70 also includes a first surface 84 and an opposite second surface 86. The first surface 84 forms an inner surface of the cuff strap 70 when the cuff strap 70 is wrapped around the cuff portion 6 of the glove 2 as described below. A second surface of the wrist strap is in contact with but does not engage with the cuff portion 6. A distal region of the first surface 84, proximate or at the distal end 76, includes a first releasable securing element 88*a*. In this example the first releasable securing element 88a comprises an area of hook and loop material. Preferably the first releasable securing element 88a comprises hook material.

The cuff strap 70 is attached to the cuff portion 6 of the glove and is designed to be wrapped around the cuff portion 6 to tighten and secure the cuff portion 6 of the glove 2 around a wearer's wrist and forearm. To secure the cuff strap 70 in its wrapped configuration, a second releasable securing element 88*b* is provided on a part of the dorsal section 60 of the cuff portion 6, as shown most clearly in FIG. 11. In this example the second releasable securing element 88*b* comprises an area of hook and loop material. Preferably the second releasable securing element 88*b* comprises loop material. When the cuff strap 70 is wrapped around the cuff portion 6 of the glove 2, the first releasable securing element 88*a* releasably engages with the second releasable securing element 88*b* to retain the cuff strap 70 securely in the wrapped configuration.

The wrist strap 90 is an elongate strap extending between a first end 92 and a second end 94, and a length of the wrist strap 90 is defined between the first and second ends 92, 94.

The wrist strap 90 is secured to the cuff portion 6 of the glove 2 proximate the outer or ulnar edge 78 of the cuff portion 6. In this example the wrist strap 90 is secured to the volar section 62 of the cuff portion 6, as shown most clearly in FIG. 10. The wrist strap 90 is secured to the cuff portion 6 in a securing region 96 of the wrist strap 90 at a distance from both the first and second ends 92, 94. In this way, a first part 98 of the wrist strap 90 is disposed between the securing region 96 and the first end 92, and a second part 100 of the wrist strap 90 is disposed between the securing region 96 and the second end 94.

The wrist strap 90 is secured to the cuff portion 6 such that the wrist strap 90 is disposed adjacent the hand portion 4 of the glove 2. In this way, the location of the wrist strap 90 will be coincident with the wearer's wrist inside the glove 2. As shown most clearly in FIGS. 9 and 11, the wrist strap 90 is also disposed proximate the first side edge 80 of the cuff strap 70, so that the wrist strap 90 overlies an edge region of the cuff strap 70 adjacent the first side edge 80 when the wrist strap 90 is secured to the cuff strap 70 as described below.

The first part 98 of the wrist strap 90 extends across the volar section 62 of the cuff portion 6. A guide element or buckle loop 102 is secured to the first end 92 of the wrist strap 90. The length of the first part 98 of the wrist strap 90 is such that the first end 92 and the buckle loop 102 lie midway across the volar section 62 of the cuff portion 6. In this example the buckle loop 102 lies at a position coincident or aligned with a part of the split 64. The buckle loop 102 is sized to receive the second part 100 of the wrist strap 90 therethrough.

The second part 100 of the wrist strap 90 extends across the dorsal section 60 of the cuff portion 6. As shown most clearly in FIG. 11, to prevent the second part 100 of the wrist strap 90 covering part of the second releasable securing element 88*b* the second part 100 of the wrist strap 90 extends through a pocket or sleeve 104 defined underneath a part of the second releasable securing element 88*b*. The second part 100 of the wrist strap 90 is preferably free to move though the sleeve 104, such that the second part 100 of the wrist strap 90 is free to move with respect to the second releasable securing element 88*b*. The sleeve 104 does, however, preferably constrain movement of the second part 100 of the wrist strap 90 in a direction perpendicular to a length of the second part 100 of the wrist strap 90. An end portion of the second part 100 of the wrist strap 90 extends from the dorsal section 60 and is sized to wrap around a part of the volar section 62 of the cuff portion 6 and engage with the buckle loop 102 and the cuff strap 70.

The wrist strap 90 is designed to provide greater support to a wearer's wrist than with a single cuff strap 70. However, it is desirable if a wearer does not have to independently adjust and secure a separate wrist strap 90 and cuff strap 70 each time a wearer puts on the glove 2.

The end portion of the second part 100 of the wrist strap 90 includes a third releasable securing element 106 proximate the second end 94. The third releasable securing element 106 is configured to releasably engage with the first releasable securing element 88*a*. Accordingly, the third releasable securing element 106 may be identical or similar to the second releasable securing element 88*b*. In this example the third releasable securing element 106 comprises hook and loop material. In particular, the third releasable securing element 106 comprises an area of loop material.

Figure 13:
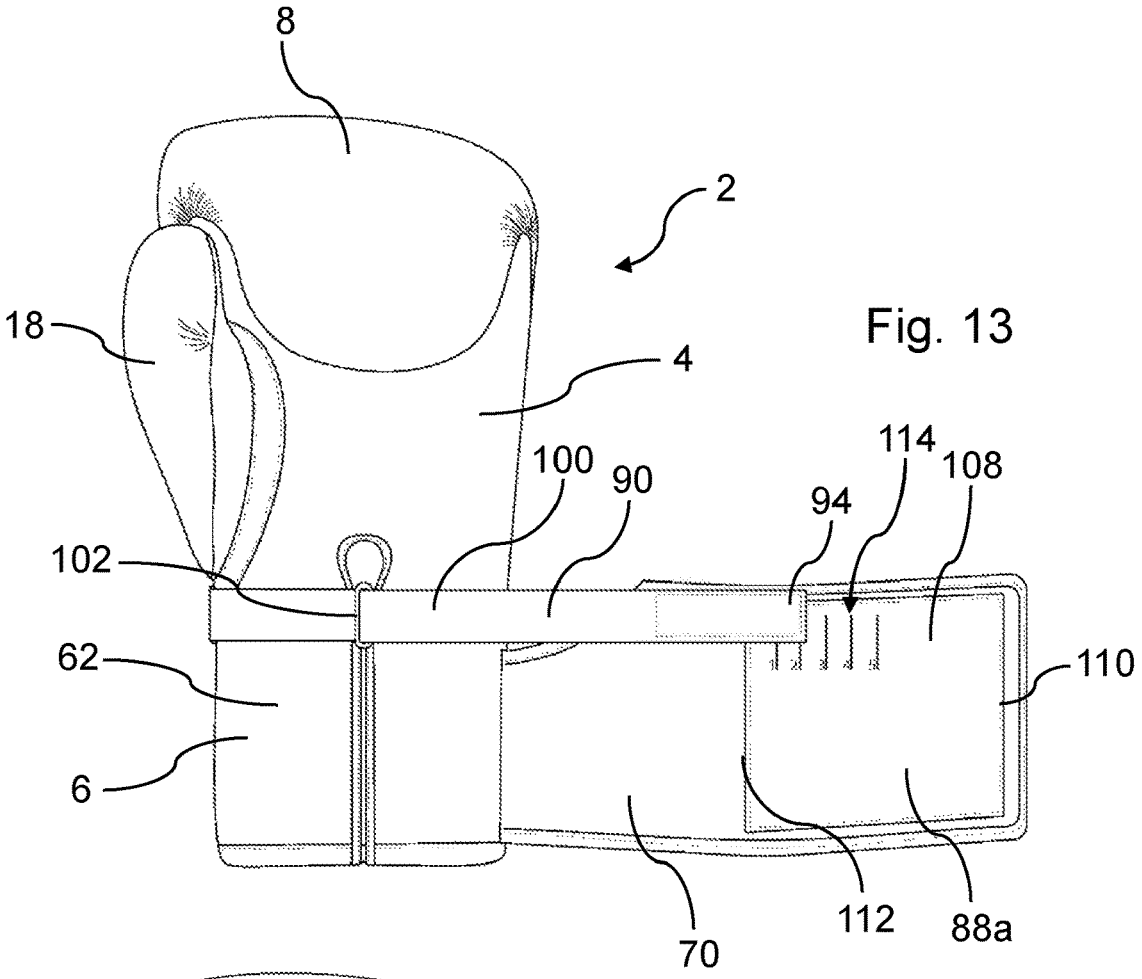
FIGS. 13 and 14 are views of the boxing glove of FIG. 9 from the palm side showing the wrist strap being engaged with the cuff strap.
Figure 14:
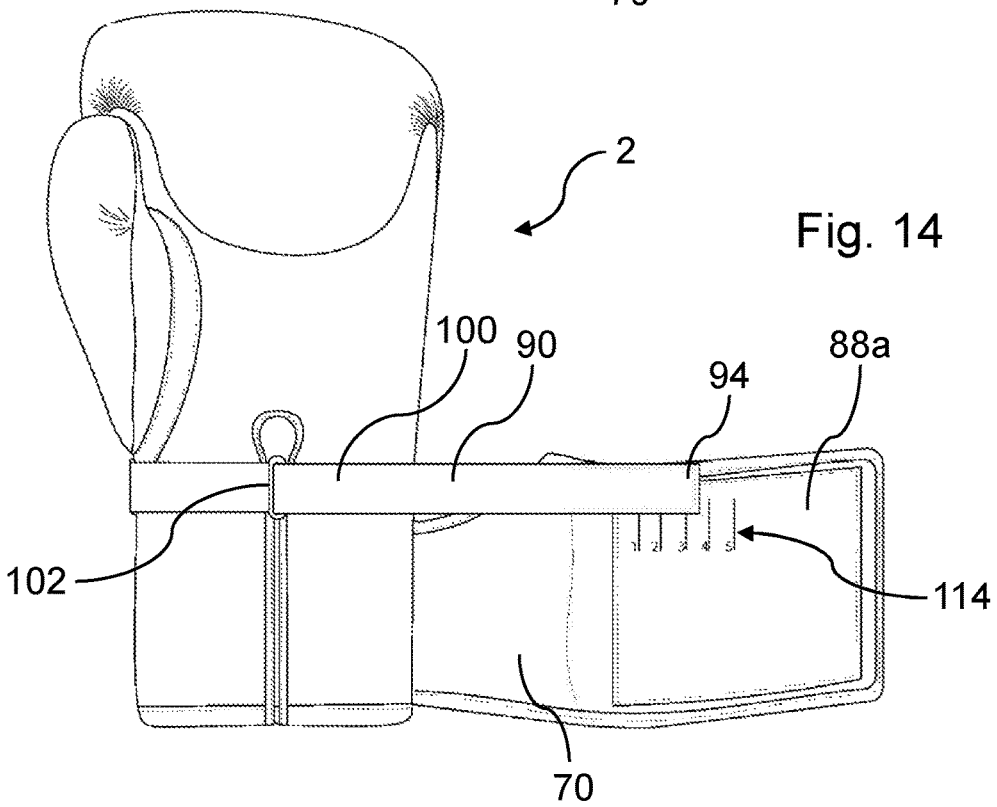

Referring now to FIGS. 13 and 14, in use, after threading the second part 100 of the wrist strap 90 through the buckle loop 102, a wearer engages the third releasable securing element 106 with a part of the first releasable securing element 88*a*. As it is also necessary for the first releasable securing element 88*a* to engage with the second releasable securing element 88*b* to secure the cuff strap 70 in the wrapped configuration, the area or size of the third releasable securing element 106 is substantially smaller than the area or size of the first releasable securing element 88*a*, such that when the wrist strap 90 is secured to the cuff strap 70 a substantial part of the first releasable securing element 88*a* is still visible and available for connection to the second releasable securing element 88*b*.

The third releasable securing element 106 may be securable to the first releasable securing element 88*a* in a number of different positions relative to the first releasable securing element 88*a*. In particular, the first releasable securing element 88*a* preferably extends across a securing area or region 108 of the cuff strap 70 having a first edge 110 proximate or adjacent the distal end 76 of the cuff strap 70 and an opposite second edge 112 furthest from the distal end 76 of the cuff strap 70. It is desirable if the wrist strap 90 can be secured to the cuff strap 70 at various positions along the length of the securing region 108, so that the second end 94 of the wrist strap 90 may be located at different distances from the first edge 110 of the securing region 108.

To allow a wearer to repeatedly attach the third releasable securing element 106 to the first releasable securing element 88*a* in the same position on a number of different occasions, the first releasable securing element 88*a* may include a plurality of markings or indicia 114. The indicia 114 may be spaced along a length of the securing region 108 between the first and second edges 110, 112.

As described further below, the wrist strap 90 and cuff strap 70 are configured such that a wearer does not need to detach the wrist strap 90 from the cuff strap 70 to remove the glove 2. However, it is likely that the wearer will need to adjust the wrist and cuff straps 90, 70 at some time, or the wearer may be using a different pair of boxing gloves 2, for example in a training scenario. As such, it is beneficial if the wearer can attach the wrist strap 90 to the cuff strap 70 in a known position using the indicia 114 as reference.

Figure 15:
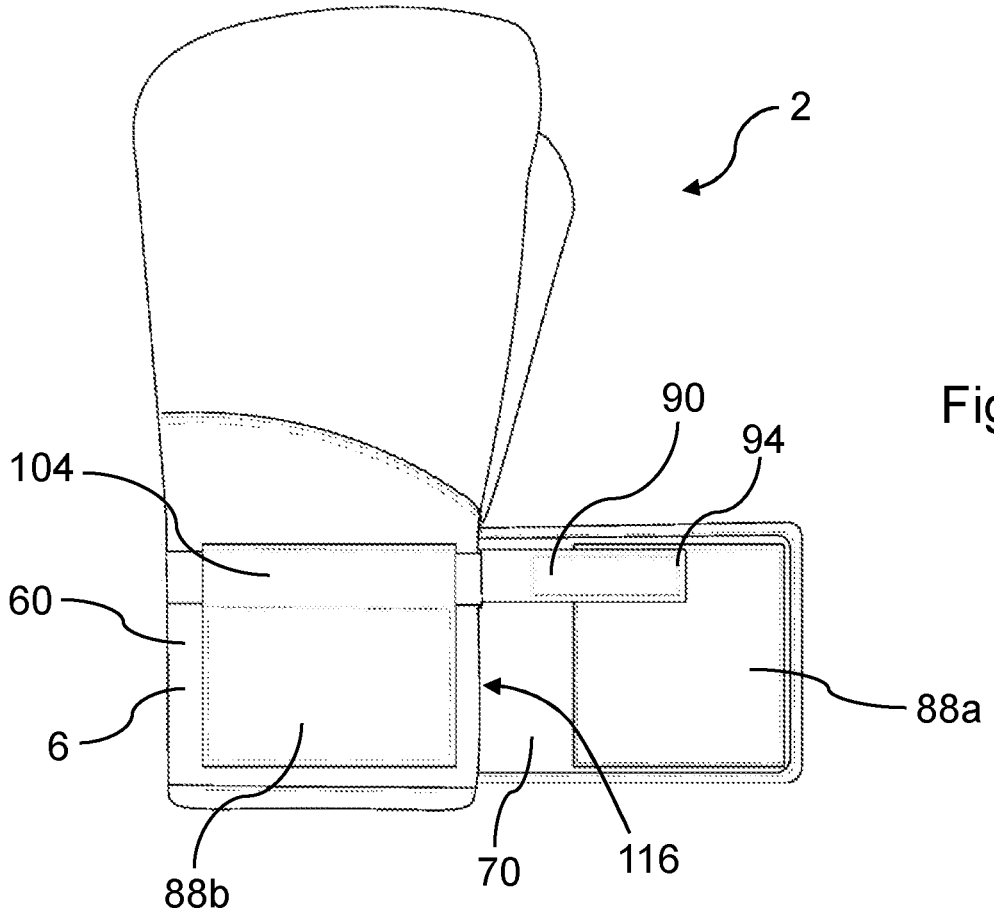
FIG. 15 is a view of the boxing glove of FIG. 9 from the rear side showing the wrist strap engaged with the cuff strap and the cuff strap partially wrapped around a cuff portion of the glove.
Figure 16:
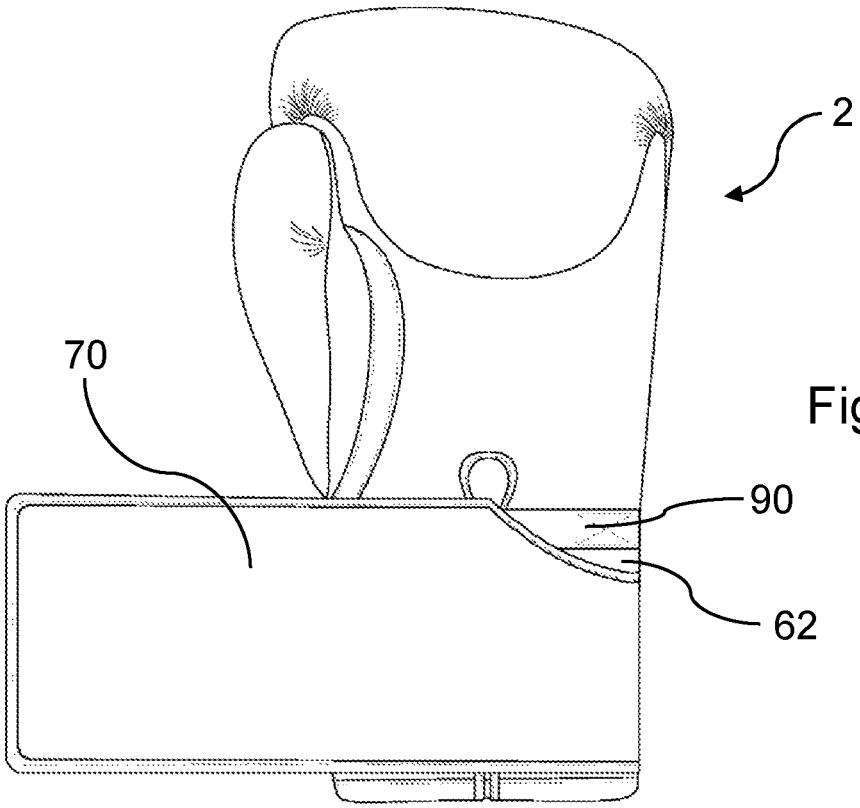
FIG. 16 is a view of the boxing glove of FIG. 15 from the palm side.

Referring now to FIGS. 15 and 16, after engaging the third releasable securing element 106 with the first releasable securing element 88*a*, the wearer can insert their hand into the glove 2. Once their hand is fully inserted, the wearer pulls or wraps the cuff strap 70 around the cuff portion 6 of the glove 2. In particular, the wearer pulls the cuff strap 70 across the volar section 62 of the cuff portion 6, wraps an end portion of the cuff strap around an inner or radial edge region 116 of the cuff portion 6, and secures the first releasable securing element 88*a* to the second releasable securing element 88*b* on the dorsal section 60 of the cuff portion 6. This therefore tightens the cuff strap 70 and the cuff portion 6 of the glove 2 around the wearer's wrist and forearm.

As the cuff strap 70 is pulled across the volar section 62, the second part 100 of the wrist strap 90 is pulled through the buckle loop 102 and, guided and restrained by the buckle loop 102, is folded back over itself. The second part 100 of the wrist strap 90 is therefore looped through the buckle loop 102. Pulling the cuff strap 70 then acts to tighten the wrist strap 90 around the wrist of the wearer. It will be appreciated that if the third releasable securing element 106 is engaged with the first releasable securing element 88*a* such that the second end 94 of the wrist strap 90 is close to the first edge 110 of the securing region 108, the wrist strap 90 will be pulled tighter around the wearer's wrist as the cuff strap 70 is pulled than if the third releasable securing element 106 is engaged with the first releasable securing element 88*a* such that the second end 94 of the wrist strap 90 is at a greater distance from the first edge 110 of the securing region 108.

Accordingly, the combination of the cuff strap 70 and wrist strap 90 allows the cuff portion 6 of the glove to be tightened around the wrist and forearm of a wearer in a single action; but allows the degree of tightness or support around the wrist of the wearer to be adjusted relative to and partially independently of the tightness or support around the forearm of the wearer by appropriate engagement of the third releasable securing element 106 with the first releasable securing element 88*a*.

The boxing glove 2 includes numerous regions or areas of padding. It will be appreciated that padded regions are primarily, but not exclusively, disposed adjacent striking surfaces of the boxing glove 2, for example the striking surface 14 of the fist portion 8 and the back or outside of the thumb.

Figure 3:
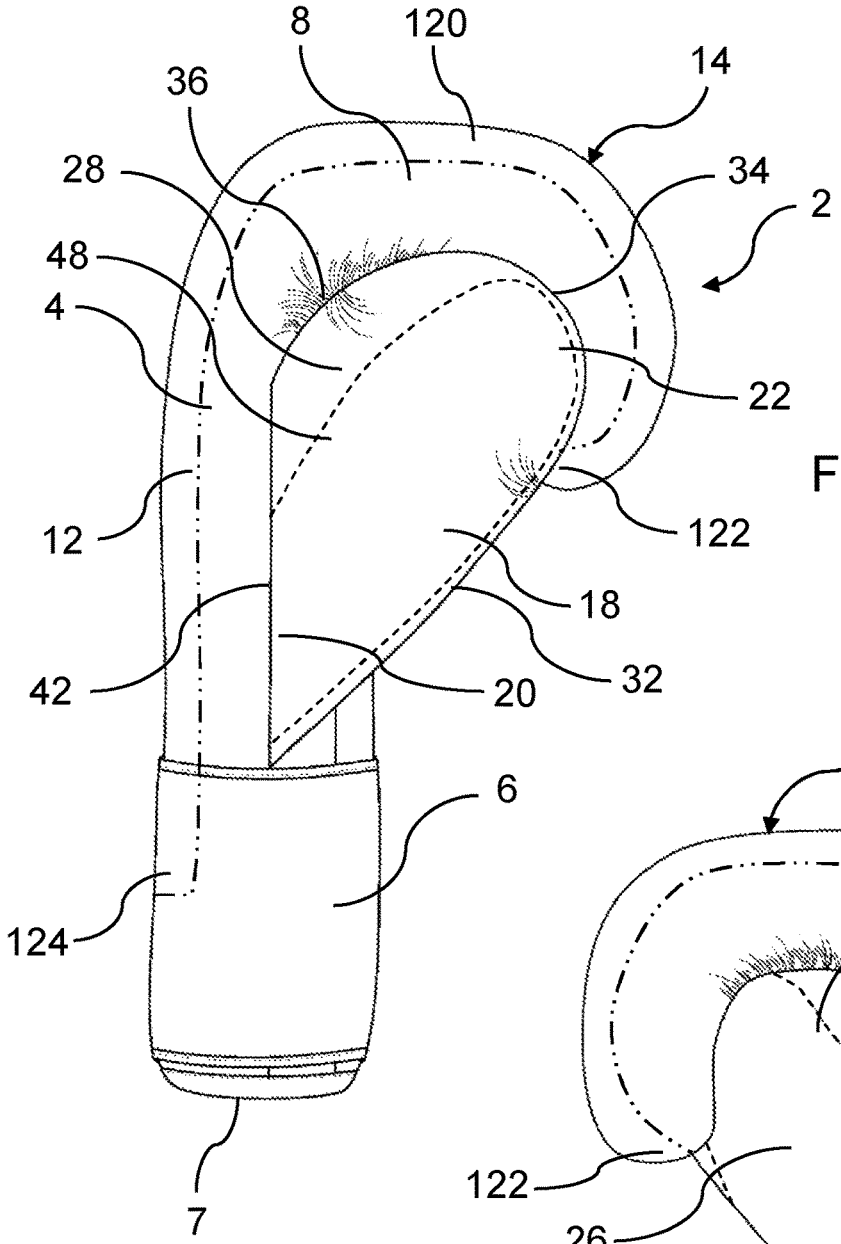
FIG. 3 is a side view from a radial or thumb side of the boxing glove of FIG. 1.
Figure 4:
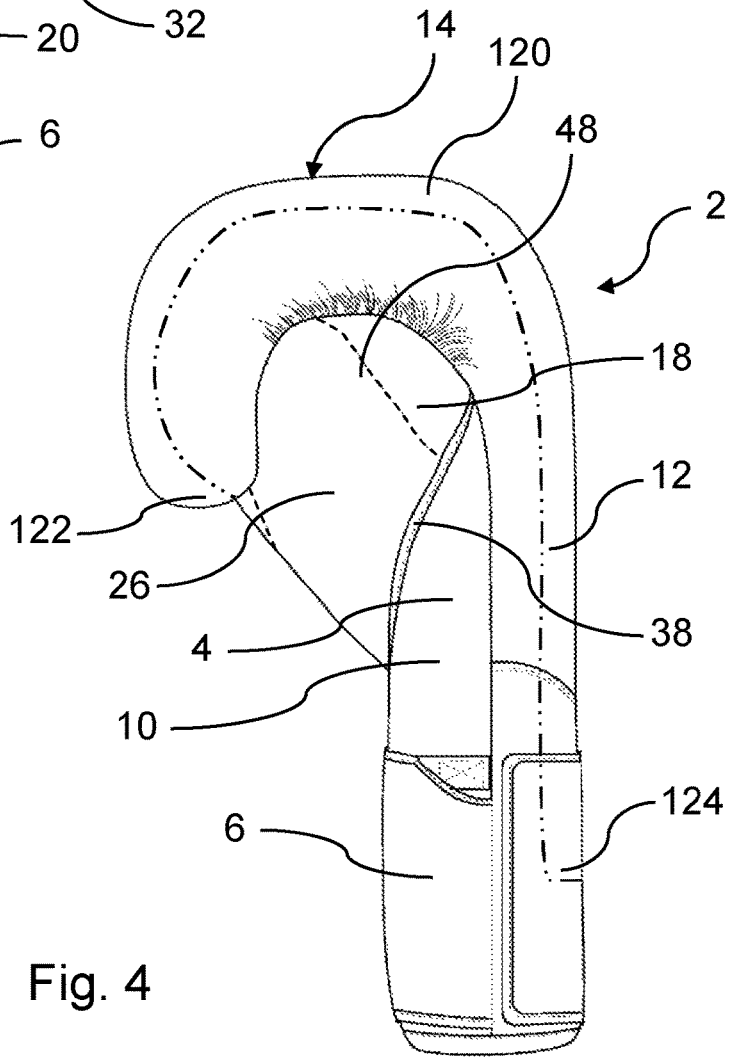
FIG. 4 is a side view from an ulnar side of the boxing glove of FIG. 1.

Referring now to FIGS. 3 and 4, a first padded region 120 (bounded by the dash-dot lines) extends across the back of the hand portion 4. In particular the first padded region 120 extends across the back of the fist portion 8 and across the back region 12. The first padded region 120 also, preferably, extends partially across the dorsal section 60 of the cuff portion 6 towards the end edge 7. In this way a distal end or first end 122 of the first padded region 120 is disposed at a tip of the fist portion 8. The distal end 122 of the first padded region 120 is therefore coincident or proximate the tips of a wearer's fingers when they are inserted into the glove 2. A proximal end or second end 124 of the first padded region 120 is disposed in the cuff portion 6 of the glove 2. Preferably the proximal end 124 of the first padded region 120 is disposed closer to the end edge 7 than the wrist strap 90. In use, this first padded region 120 therefore provides support to a wearer's wrist. The extension of the first padded region 120 into the cuff portion 6 acts to brace the back of a wearer's wrist so that the extent to which the wearer's wrist can flex backwards (extension of the wrist) is minimised or reduced.

The boxing glove 2 may include, in particular, an additional layer of padding, or a part of the first padded region 120 having a greater thickness, that extends over a part of the back region 12 and into the cuff portion 6. In this way this area of thicker padding is coincident with or overlies the position of the wearer's wrist within the glove 2. The inclusion of this additional wrist bracing in the form of an extension to the first padded region 120, together with the wrist strap 90 means that the boxing glove 2 is able to provide more support to a wearer's wrist compared with currently known boxing gloves, thereby reducing the likelihood of injury to a wearer's wrist.

Figure 6:
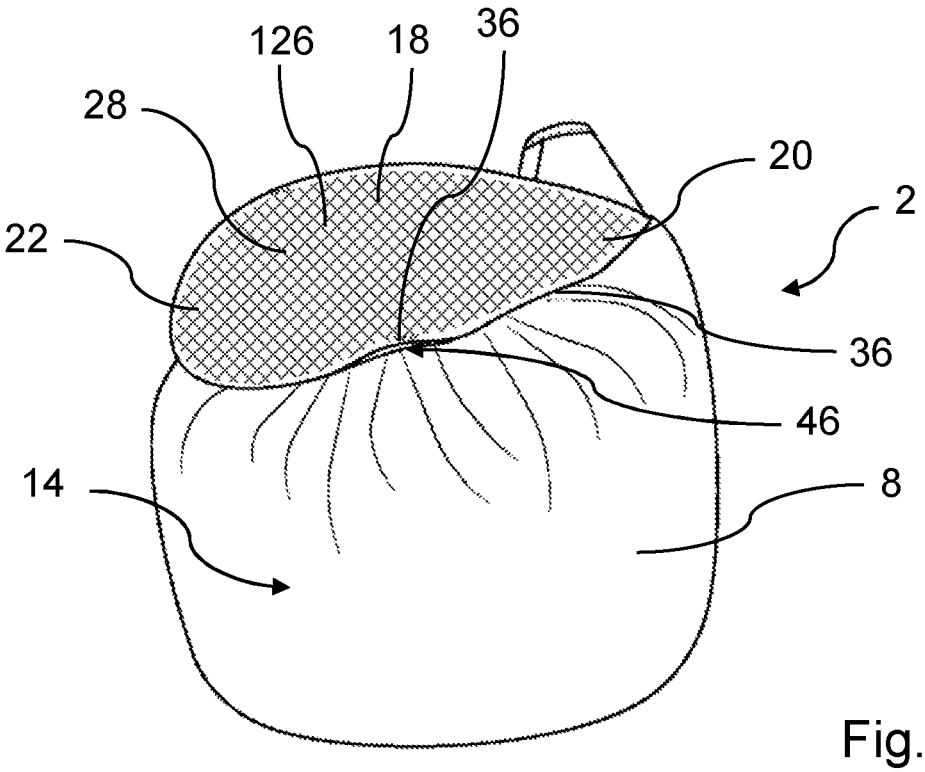
FIG. 6 is a perspective view from a top of the boxing glove of FIG. 1.

A second padded region 126 extends along the back of the thumb portion 18, as illustrated by the hatched region in FIG. 6. The second padded region 126 preferably extends fully across the thumb portion 18 between the inner edge section 36 and the outer edge section 32 of the edge seam 30, and fully along the length of the thumb portion 18 between the proximal thumb seam 38 and the tip section 34 of the edge seam 30.

Figure 5:
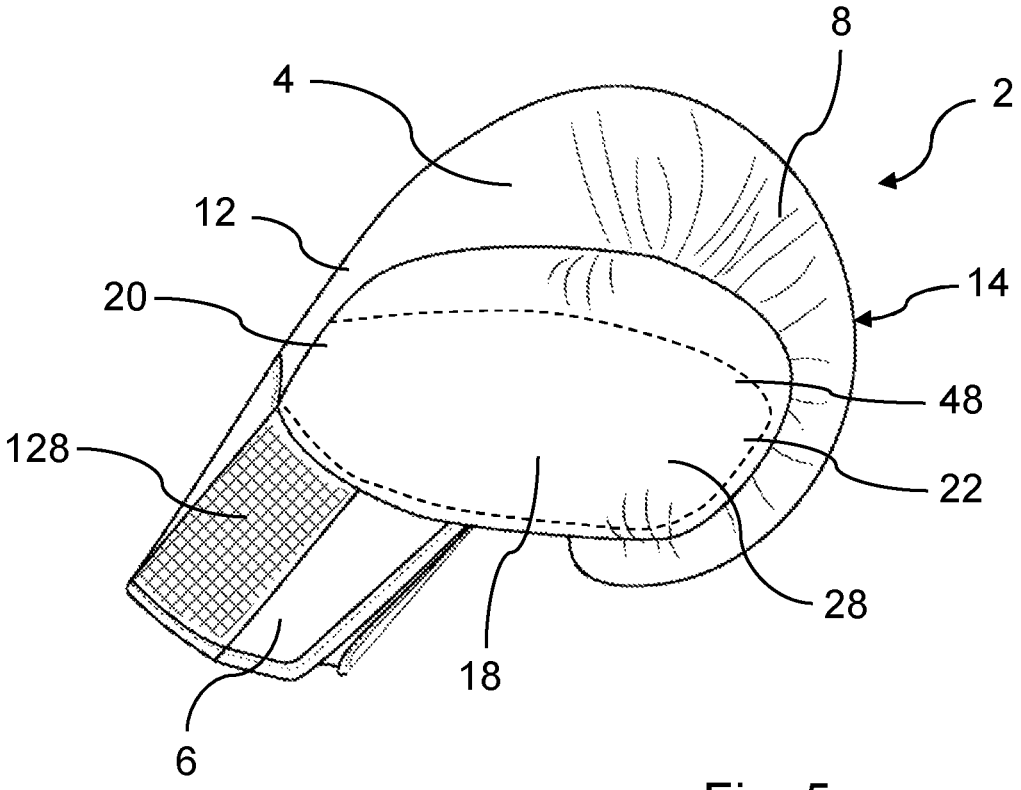
FIG. 5 is a perspective view from a side of the boxing glove of FIG. 1.
Figure 12:
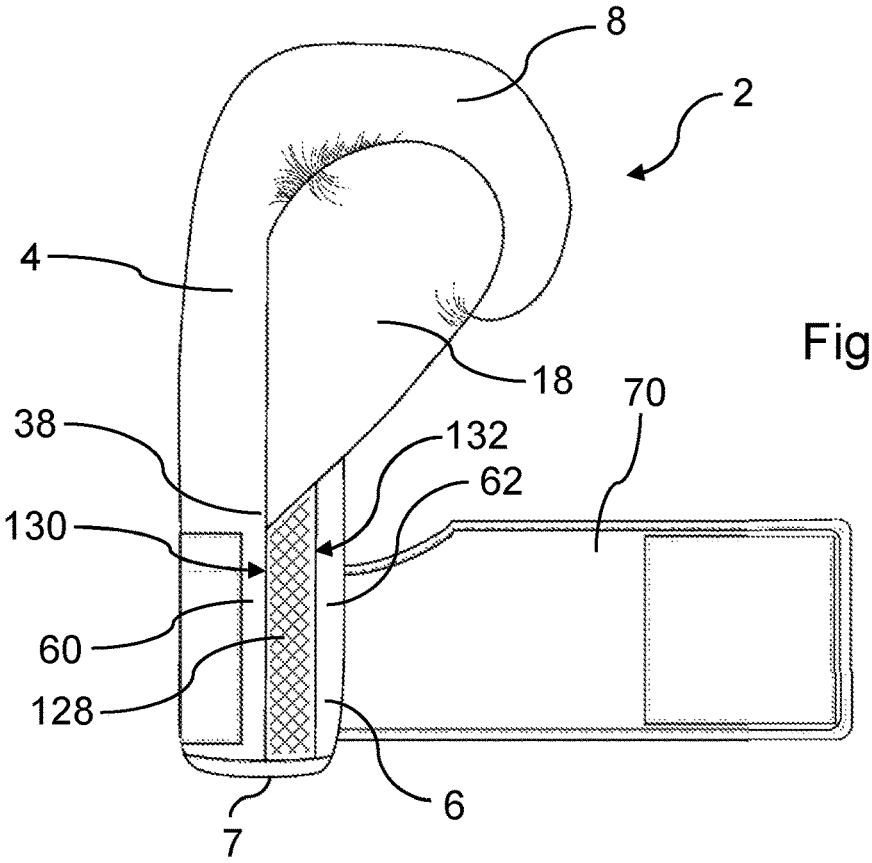
FIG. 12 is a view of the boxing glove of FIG. 9 from the radial side showing the cuff strap partially closed.

A third padded region 128, indicated in FIGS. 5 and 12, is disposed in the inner or radial edge region 116 of the cuff portion 6. As shown most clearly in FIG. 12, a dorsal side seam 130 is disposed between the radial edge region 116 and the dorsal section 60 of the cuff portion 6, and a volar side seam 132 is disposed between the radial edge region 116 and the volar section 62 of the cuff portion 6. The third padded region 128 preferably comprises a panel of padding material that extends in a first direction between the proximal thumb seam 38 and the end edge 7, and extends in a second orthogonal direction between the dorsal side seam 130 and the volar side seam 132.

The third padded region 128 acts to brace the side of a wearer's wrist so that the extent to which or ease with which the wearer's wrist can flex sideways (abduction of the wrist) is minimised or reduced.

It will be appreciated that outer or external panels and surfaces of the boxing glove 2 are preferably made from a suitable leather material. Alternatively they may be made from another suitable material, which may be a man-made or synthetic material, such as vinyl. The padded regions are preferably formed from a suitable foam material. The foam material is preferably a polymeric material, for example latex or polyvinyl chloride (PVC). The padded regions may be formed by layered foam or injection moulded foam.

In some examples the thumb portion 18 may not comprise separate inner and outer panels 26, 28 as described above but may, instead, comprise inner and outer regions. Similarly, the thumb portion 18 may not include an edge seam 30 that includes both inner and outer edge sections 36, 32 as described above. The edge seam 30 may include only one of the inner and outer edge seams if, for example, the thumb portion is formed from a folded panel of material.

Although, typically, the thumb portion 18 will be made from separate panels of material to the hand portion 4, in some examples at least a part of the thumb portion 18 may be integral with the hand portion 4. In other words, a part of the thumb portion may be formed from a part of the same panel of material as at least a part of the hand portion 4. Accordingly, the proximal thumb seam 38 will delineate or differentiate the thumb portion 18 from the palm and back regions 10, 12.

In the above example the thumb portion 18 was secured to the fist portion 8 over a proximal region of the thumb portion 18 and a tie strap 44 extended between the tip or distal end 22 of the thumb portion 18 and the fist portion 8. In other examples the thumb portion 18 may be connected to the fist portion 8 along the complete length of the thumb portion 18 between the proximal thumb seam 38 and the distal end 22. The thumb portion 18 may be connected directly to the first portion 8 in some examples, while in other examples a panel or web may extend between the thumb portion 18 and the fist portion 8 so as to indirectly attach the thumb portion 18 to the first portion 8. In some examples a proximal region of the thumb portion 18 may be directly connected to the fist portion 8 and a distal region of the thumb portion 18 may be indirectly connected to the fist portion 8 such that there is no gap between the thumb portion 18 and the fist portion 8 along the complete length of the thumb portion 18 between the proximal thumb seam 38 and the distal end 22.

In variations of the boxing glove, in place of the hook and loop material the first, second and third securing elements 88*a*, 88*b*, 106 may comprise any suitable releasable fasteners, such as snap fasteners. It will be appreciated that one or more of the first, second and third securing elements 88*a*, 88*b*, 106 may comprise a plurality of fasteners, such as snap fasteners, to allow the wrist strap to be attached to the cuff strap in a plurality of different positions and to allow the cuff strap to be secured to the cuff portion in a plurality of different positions. It is desirable if a wearer can fasten and unfasten the securing elements while wearing the boxing glove. This allows a wearer to secure a second glove over a second hand after putting a first glove on a first hand.

In the above example the boxing glove 2 included a single wrist strap 90. This allowed the glove 2 to be tightened to different degrees around the wrist and forearm of the wearer. It will be appreciated that the more adjustment there is along the cuff portion the better the fit of the glove in this region and the more support the glove provides to a wearer's wrist. This is the advantage of laced boxing gloves. It is, however, desirable for a wearer to be able to put on their own gloves, especially in a training session. As such, in some examples, the boxing glove preferably includes more than one wrist strap 90. In these examples the two or more wrist straps 90 are preferably spaced apart in a direction between the hand portion 4 and the end edge 7. Each of the wrist straps 90 may be secured to the cuff strap 70 independently. This allows, in particular, the second end 94 of each of the wrist straps 90 to be located at different distances from the first edge 110 of the securing region 108. In this way the wrist straps 90 can be adjusted to suit the shape of the wearer's wrist and to provide the required level of support to the wrist. The cuff strap 70, and all of the wrist straps 90, can still be secured and tightened around the wearer's wrist and forearm in a single action.

Although in the above example the cuff strap 70 had a single securing element 88*a* for securing to both the wrist strap 90 and the dorsal section 60 of the cuff portion 6, in other examples the cuff strap may include more than one securing element. For example, the cuff strap may include a first securing element to which one or more wrist straps are secured and a second securing element to secure the cuff strap to the dorsal section of the cuff portion.

FIGS. 17 to 23 illustrate a boxing glove 202 according to a second preferred example. This boxing glove 202 is very similar to the boxing glove 2 of the first example described above and like features have been indicated with reference numbers incremented by 200.

The boxing glove 202 comprises a hand portion 204 and a cuff portion 206. The hand portion 204 comprises a first portion 208, a palm region 210 and a back region 212. The palm region 210 extends between the first portion 208 and the cuff portion 206. The back region 212 extends between the first portion 208 and the cuff portion 206. An outer, striking surface 214 of the first portion 208 extends from and is continuous with the back region 212. An inner surface 216 (shown in FIG. 17) of the first portion 208 extends from and is continuous with the palm region 210. There is a seam 217 between the inner surface 216 of the first portion 208 and the palm region 210. This seam 217 is preferably curved.

The hand portion 204 further comprises a thumb portion 218 for receiving the wearer's thumb. The thumb portion 218 has a proximal end 220 connected to and between the palm region 210 and the back region 212. The thumb portion 218 extends in a direction towards the first portion 208 and a distal end 222 of the thumb portion 214 is disposed adjacent a first edge or index edge 224 of the first portion 208.

In this example the thumb portion 218 comprises an inner panel 226, extending generally from the palm region 210, and an outer panel 228, extending generally from the back region 212. An edge seam 230 extends around the thumb portion 218 and joins the inner panel 226 to the outer panel 228. A proximal thumb seam 238 extends around the proximal end 220 of the thumb portion 218 to join the thumb portion 218 to the palm region 210 and the back region 212. A palm section 240 of the proximal thumb seam 238 extends between the inner panel 226 and the palm region 210 and a back section 242 of the proximal thumb seam 238 extends between the outer panel 228 and the back region 212.

It will be appreciated that the inner panel 226 preferably comprises an outer layer, which is preferably made of a suitable leather material, and an inner layer or lining layer. The inner layer may be made of a leather or fabric material. Similarly, the palm region also preferably comprises an outer layer, which is preferably made of a suitable leather material, and an inner layer or lining layer. The inner layer may be made of a leather or fabric material.

In prior art boxing gloves, at least an edge region of the outer layer of the inner panel is joined to an edge region of the outer layer of the palm region to form the palm section of the proximal thumb seam. Due to the method of construction of the boxing gloves, the free edge of the outer layer of the inner panel and the free edge of the outer layer of the palm region are disposed on an external side of the outer layer. The free edges are then covered by a strip of leather material which is sewn along each of its long edges. This may therefore be considered to be in the form of a bound seam.

In contrast, in this example, a free edge of the outer layer of the inner panel 226 and a free edge of the outer layer of the palm region 210 are disposed on an internal side of the outer layer. The join between the free edge of the outer layer of the inner panel 226 and the free edge of the outer layer of the palm region 210 is preferably in the form of an open seam or plain seam. The join may be in the form of a double-stitched seam.

Similarly, a free edge of the lining of the inner panel 226 and a free edge of the lining of the palm region 210 are disposed on an external side of the lining. The join between the free edge of the lining of the inner panel 226 and the free edge of the lining of the palm region 210 is preferably in the form of an open seam or plain seam. The join may be in the form of a double-stitched seam.

A part of the lining is then stitched to a part of the outer layer so that the free edges of both the lining and the outer layer are disposed between the lining and the outer layer. It is therefore not necessary to include an additional layer or strip of leather covering the join. This seam is, therefore, not a bound seam.

Considering the appearance of this seam: in prior art boxing gloves there are two rows of stitches each one extending along an edge of an additional strip of leather overlaying the join; while in the present example the join is clearly visible. In the present example there may be a row of stitches on either side of the join attaching the lining to the outer layer of the glove, or forming the stitches of a double-stitched seam.

Forming the palm section 240 of the proximal thumb seam 238 in this way decreases the bulkiness of this part of the thumb seam compared to prior art constructions. This allows the thumb portion 218 to sit closer to the first portion 208 and palm region 210 than in prior art boxing gloves. This in turn improves the aerodynamics of the boxing glove by creating a more streamlined shape of the hand portion 204 of the glove.

Figure 21:
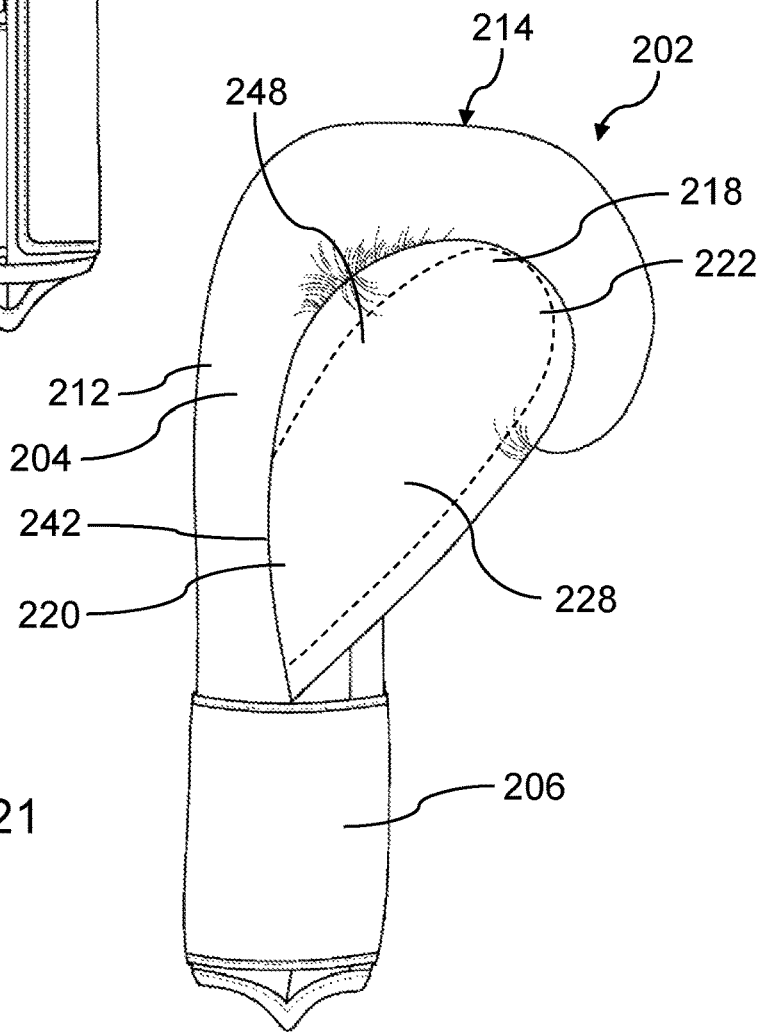
FIG. 21 is a side view from a radial or thumb side of the boxing glove of FIG. 17.

In the present example the thumb portion 214 includes an internal thumb pocket 248, shown in FIG. 21. The thumb pocket 248 is substantially identical in construction to the thumb pocket 48 described above in relation to the first example and will not be described further here. In this embodiment the thumb pocket 248 is disposed approximately midway across the external width of the thumb portion 218.

Figure 17:
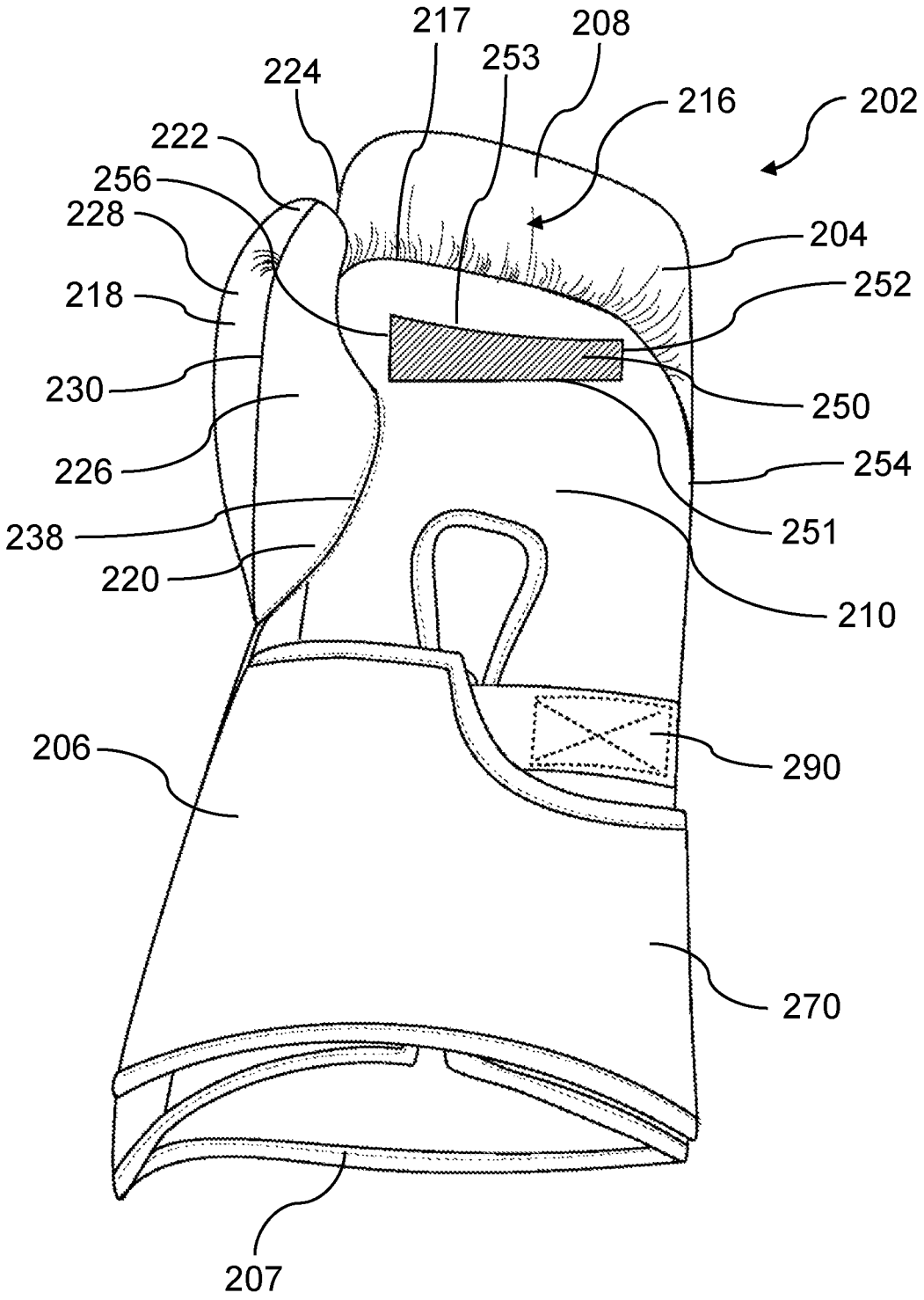
FIG. 17 is a perspective view from a lower or cuff end of a boxing glove according to a second preferred example.

Referring now to FIG. 17, the boxing glove 202 further includes a hand bar or grip bar 250. The grip bar 250 extends transversely across the palm region 210 adjacent the first portion 208.

The grip bar 250 is preferably made from a polymeric material in the form of a dense foam. In this example the grip bar 250 is in the form of an elongate block of dense polymeric foam.

The grip bar 250 comprises a first elongate edge 251 and an opposite second elongate edge 253. In this example the first elongate edge 251 is straight or planar and the second elongate edge 253 is curved. The second elongate edge 253 preferably has a concave curvature. In other examples the second elongate edge 253 may be straight or planar. The grip bar 250 further comprises opposite first and second end edges 252, 256. The first and second end edges 252, 256 extend between the first and second elongate edges 251, 253. In this example a length of the first end edge 252 is smaller than a length of the second end edge 256. In this way, the grip bar 250 is in the form of a tapered block.

The grip bar 250 extends across the palm region 210 such that the first end edge 252 is disposed proximate an outer edge 254 of the palm region 210 furthest from the thumb portion, and the second end edge 256 is disposed proximate the index edge 224 of the first portion 208. The second elongate edge 253 lies closer to the seam 217 between the inner surface 216 of the first portion 208 and the palm region 210 than the first elongate edge 251, i.e. a distance between the second elongate edge 253 and the seam 217 is smaller than a distance between the first elongate edge 251 and the seam 217.

The grip bar 250 is disposed between an outer layer of the boxing glove and an inner layer or lining of the boxing glove. The grip bar 250 is preferably disposed between two longitudinal rows of stitching that extend along the length of the grip bar 250. The stitching joins the outer layer to the lining thereby forming an elongate pocket between the longitudinal rows of stitching in which the grip bar 250 is disposed. Preferably the grip bar 250 does not extend fully across the palm region 210. The grip bar 250 may therefore be held in the correct position relatively to the palm region 210 by rows of stitching extending transverse to the longitudinal rows of stitching. In particular, the transverse rows of stitching create a closed pocket within which the grip bar 250 is disposed. This prevents the position of the grip bar 250 shifting relative to the palm region 210.

The shape of the grip bar 250 means that when a wearer forms a first around the grip bar 250 the base knuckles (metacarpo phalangeal joints) of their first finger and middle finger are forced further forward (in a direction away from their wrist) relative to the base knuckles of their ring finger and little finger. The shape of the grip bar 250, together with the curved seam 217 between the first portion 208 and the palm region 210, therefore allows a wearer's fingers to form a more natural fist. In particular, this combination of features creates space for the wearer's little finger to properly grip the grip bar 250.

The cuff portion 206 extends away from the hand portion 204 in a length direction of the glove 202. The cuff portion 206 of the boxing glove 202 includes a dorsal section 260 and a volar section 262. In use, the dorsal section 260 extends over and covers the rear side of a wearer's wrist and a portion of the rear side of the wearer's forearm adjacent the wrist. The volar section 262 extends over and covers the inner side of a wearer's wrist (adjacent the palm) and a portion of the inner side of the wearer's forearm adjacent the wrist. The cuff portion 206 extends to an end edge 207 of the boxing glove 202. Each of the volar section 262 and dorsal section 260 extend between an outer or ulnar edge 278 of the cuff portion 206 and an inner or radial edge region 316 of the cuff portion 206.

The volar section 262 of the cuff portion 206 includes a split 264 that allows the cuff portion 206 to be opened to allow a wearer to insert their hand into the glove 202 more easily. The split 264 extends from the end edge 207 and terminates at a keyhole aperture or closed end 266 at a base of the palm region 210 or in the palm region 210. In this example the split 264 is centrally disposed across a width of the volar section 262.

Figure 18:
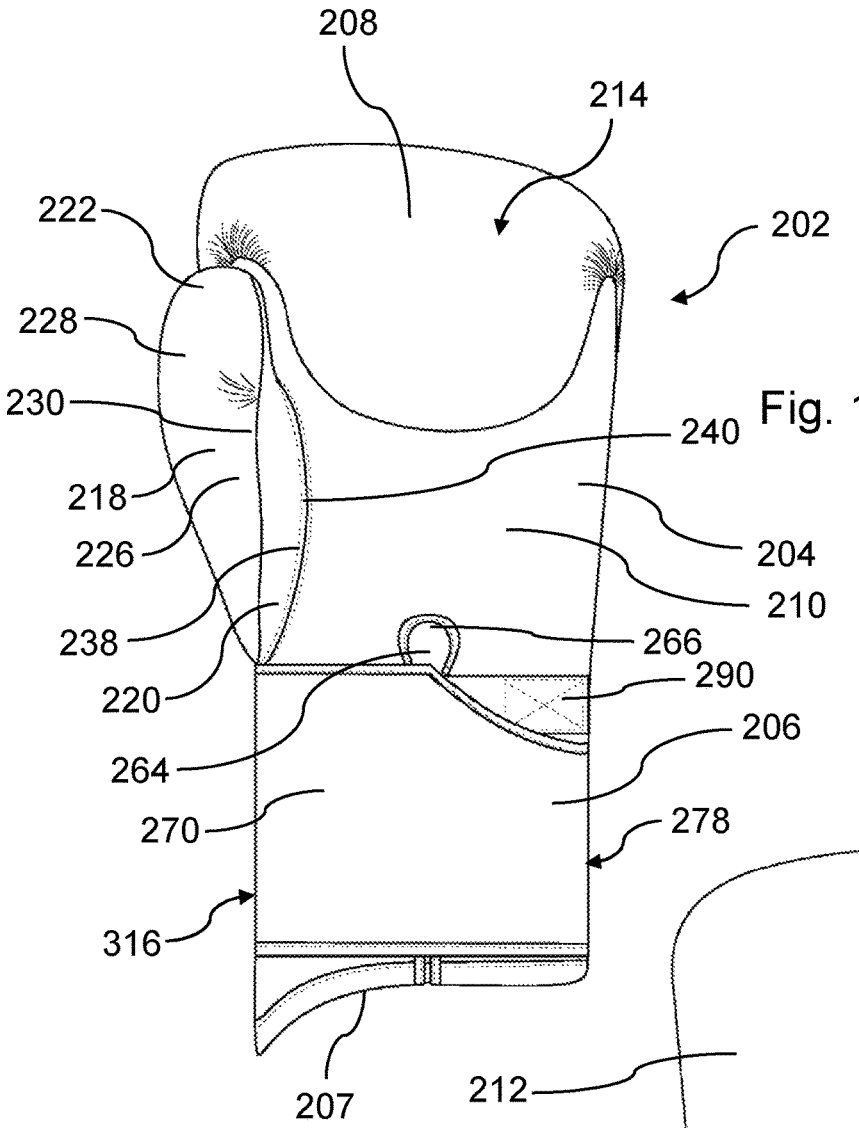
FIG. 18 is a view from a palm side of the boxing glove of FIG. 17.
Figure 19:
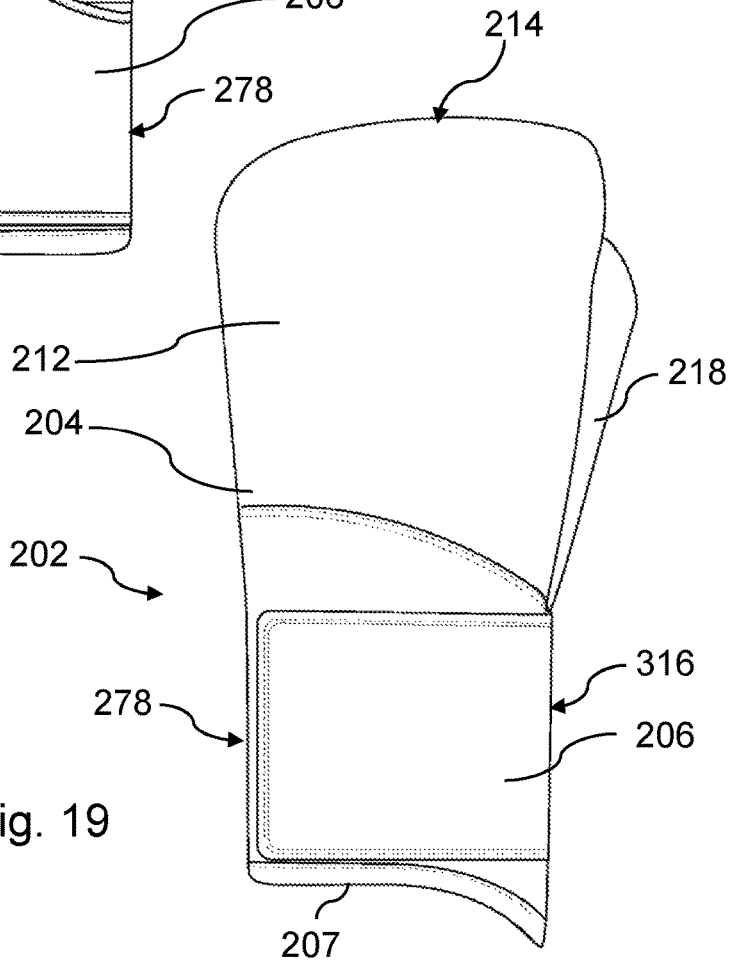
FIG. 19 is a view from a rear side of the boxing glove of FIG. 17.
Figure 20:
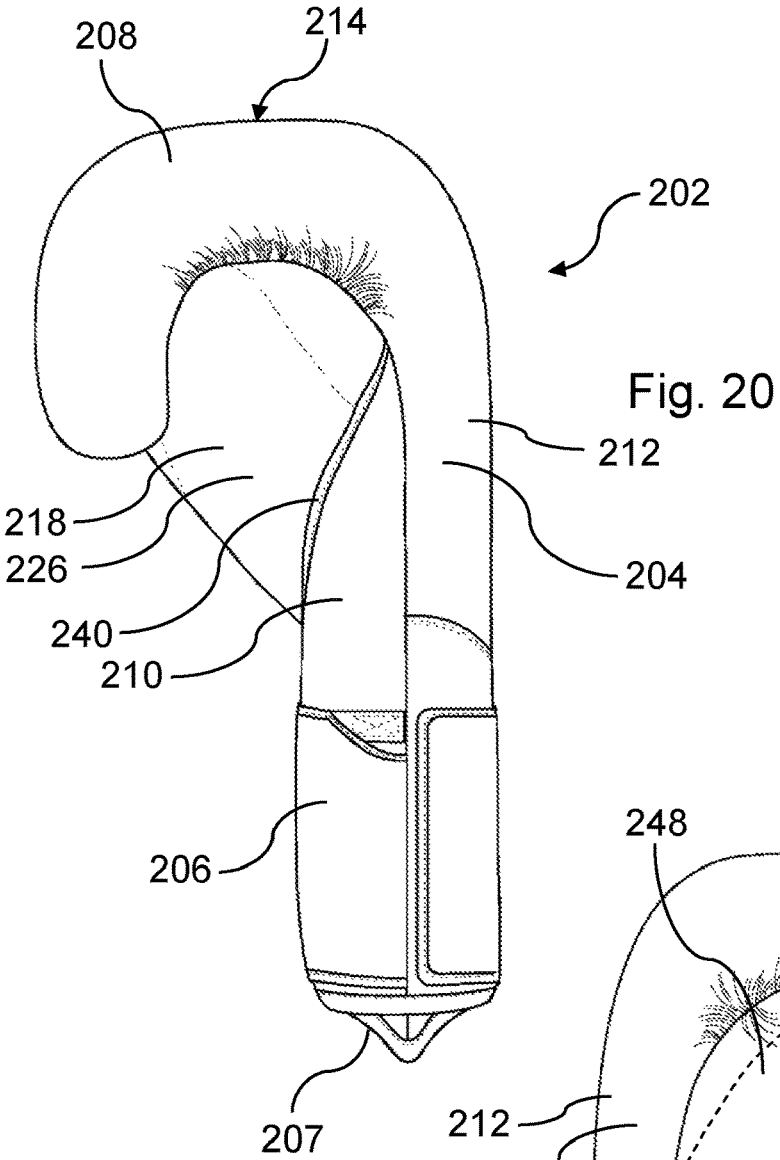
FIG. 20 is a side view from an ulnar side of the boxing glove of FIG. 17.

As shown most clearly in FIGS. 18 and 19, in this example the end edge 207 of the cuff portion 206 is curved. In particular, a part of the end edge of the volar section 262 between the split 264 and the radial edge region 316 of the cuff portion 206 is curved. Similarly, a corresponding part of the end edge of the dorsal section 260 adjacent the radial edge region 316 is curved. The curvature of the end edge 207 has a component that lies in a plane containing an axis that extends parallel to the length direction. The result is that the length of the cuff portion 206 at the radial edge region 316 is longer or greater than the length of the cuff portion 206 at the ulnar edge 278 of the cuff portion 206. The end edge 207 preferably has a concave curvature. The elongation of the cuff portion 206 at the radial edge region 316 acts to further brace the side of a wearer's wrist so that the extent to which or ease with which the wearer's wrist can flex sideways (abduction of the wrist) is minimised or reduced.

In other examples the elongation of the cuff portion 206 at the radial edge region 316 may be achieved by having a curved end edge 207 having a convex curvature. In further examples the end edge 207 may be straight but angled. In yet further examples the elongation of the cuff portion 206 may be at the ulnar edge 278 of the cuff portion 206 to brace this side of the wearer's wrist.

Figure 22:
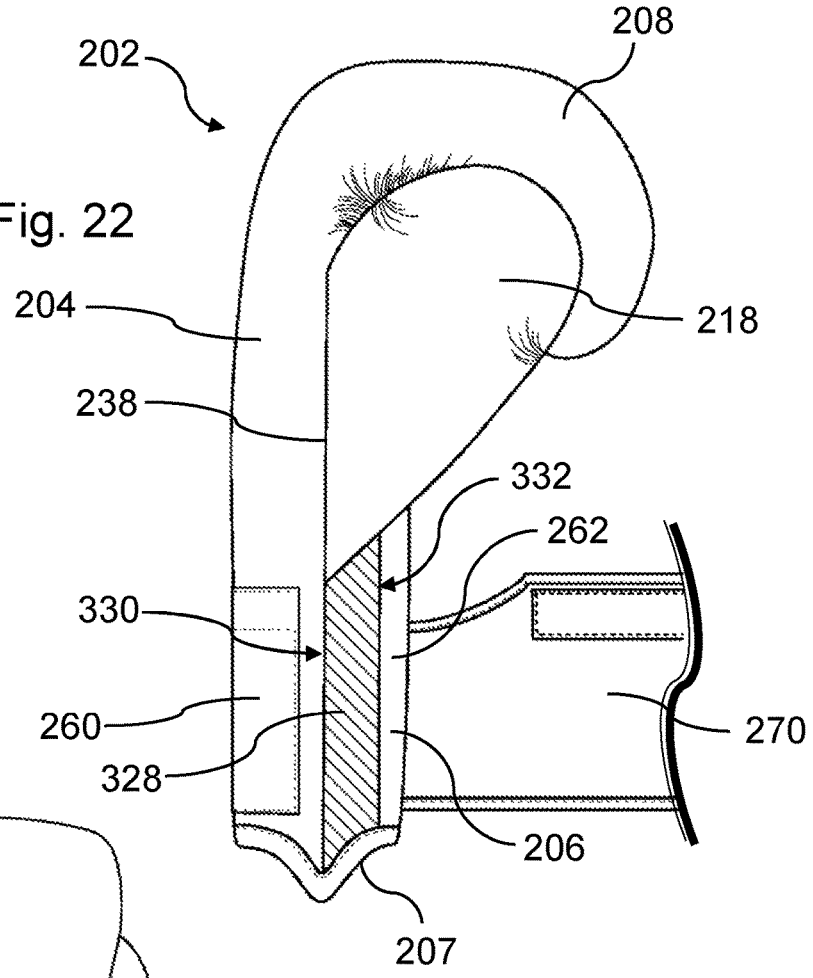
FIG. 22 is a view of the boxing glove of FIG. 17 from the radial side showing a cuff strap partially wrapped around a cuff portion of the glove.
Figure 23:
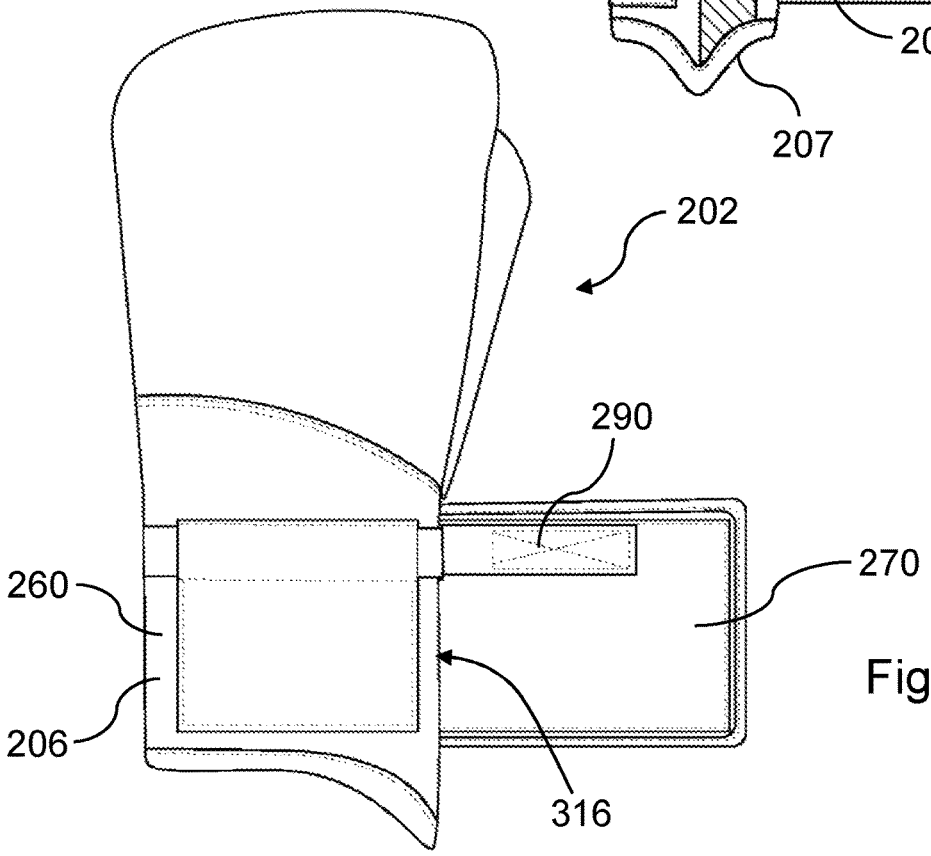
FIG. 23 is a view of the boxing glove of FIG. 22 from the rear side showing a wrist strap engaged with the cuff strap.
Figure 24:
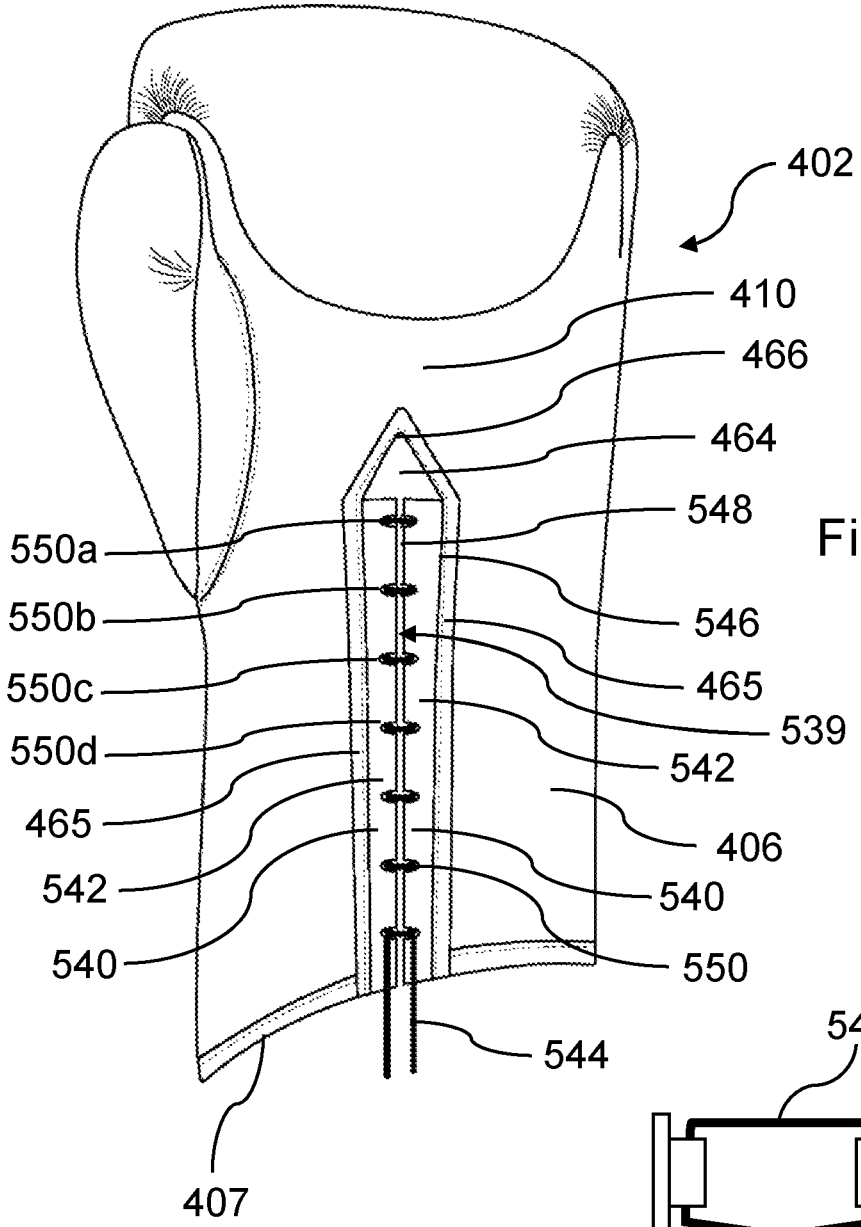
FIG. 24 is a view from a palm side of a boxing glove according to a third preferred example.

Referring now to FIGS. 22 and 23, the boxing glove 202 includes a cuff strap 270 and a wrist strap 290. The cuff strap 270 and wrist strap 290 of this example are identical to the cuff strap 70 and wrist strap 90 of the first example and will not be described further in relation to this example.

The boxing glove 202 includes numerous regions or areas of padding. It will be appreciated that padded regions are primarily, but not exclusively, disposed adjacent striking surfaces of the boxing glove 202, for example the striking surface 214 of the first portion 208 and the back or outside of the thumb.

One padded region 328, indicated in FIG. 22, is disposed in the inner or radial edge region 316 of the cuff portion 206. A dorsal side seam 330 is disposed between the radial edge region 316 and the dorsal section 260 of the cuff portion 206, and a volar side seam 332 is disposed between the radial edge region 316 and the volar section 262 of the cuff portion 206. The padded region 328 preferably comprises a panel of padding material that extends in a first direction between the proximal thumb seam 238 and the end edge 207, and extends in a second orthogonal direction between the dorsal side seam 330 and the volar side seam 332. This padded region 328 acts to brace the side of a wearer's wrist so that the extent to which or ease with which the wearer's wrist can flex sideways (abduction of the wrist) is minimised or reduced.

It will be appreciated that outer or external panels and surfaces of the boxing glove 202 are preferably made from a suitable leather material. Alternatively, they may be made from another suitable material, which may be a man-made or synthetic material, such as vinyl. The padded regions are preferably formed from a suitable foam material. The foam material is preferably a polymeric material, for example latex or polyvinyl chloride (PVC). The padded regions may be formed by layered foam or injection moulded foam.

FIGS. 24 and 26 to 28 illustrate a boxing glove 402 according to a third preferred example. This boxing glove 402 is very similar to the boxing glove 202 of the second example described above and like features have been indicated with reference numbers incremented by 200. Features of this glove 402 are identical to those of the glove 202 of the second example except that this glove 402 is a lace-up glove and, accordingly, this glove 402 does not include a cuff strap or a wrist strap as described in the earlier examples.

A cuff portion 406 of the boxing glove 402 includes a dorsal section 460 and a volar section 462. In use, the dorsal section 460 extends over and covers the rear side of a wearer's wrist and a portion of the rear side of the wearer's forearm adjacent the wrist. The volar section 462 extends over and covers the inner side of a wearer's wrist (adjacent the palm) and a portion of the inner side of the wearer's forearm adjacent the wrist. The cuff portion 406 extends to an end edge 407 of the boxing glove 402. Each of the volar section 462 and dorsal section 460 extend between an outer or ulnar edge 478 of the cuff portion 406 and an inner or radial edge region 516 of the cuff portion 406.

The volar section 462 of the cuff portion 406 includes a split 464 that allows the cuff portion 406 to be opened to allow a wearer to insert their hand into the glove 402 more easily. The split 464 extends from the end edge 407 and terminates at a keyhole aperture or closed end 466 at a base of the palm region 410 or in the palm region 410. In this example the split 464 is centrally disposed across a width of the volar section 462.

Edges 465 of the split 464 are therefore elongate and extend from the end edge 407 to the closed end 466. A lace receiving passage 540 is provided along each of the edges 465. Each lace receiving passage 540 extends laterally into a gap 539 between the edges 465 of the split 464. In this example each lace receiving passage 540 comprises an elongate tube or channel 542 through which a part of a lace 544 extends. A first lateral side 546 of the channel 542 is disposed adjacent the edge 465 of the split 464 and a second lateral side 548 of the channel 542 is disposed further from the edge 465. A plurality of apertures or slits 550 are disposed along the length of the second lateral side 548 of the channel 542. The apertures 550 are spaced apart along the length of the lace receiving passage 540, and are preferably equidistantly spaced. Each aperture 550 provides an opening in the lace receiving passage 540 to allow a lace 544 to pass into and out of the channel 542. The lace receiving passages 540 are preferably formed of the same leather material as the outside of the glove 402. The lace receiving passages 540 may be formed by a folded or rolled region of material secured to the edges 465 of the split 464.

In use, a lace 544 is inserted through each of the apertures 550 such that the lace 544 passes into and out of the channel 542 along the length of the lace receiving passage 540. It will be appreciated that when the lace 544 is tightened, the lace receiving passages 540 are pulled towards each other, thereby closing the gap 539 formed by the split 464 and securing the glove 402 to a wearer's hand and wrist. In this tightened configuration the second lateral sides 548 of the elongate tubes 542 are preferably in contact with each other.

The lace 544 may be threaded through the lace receiving passages 540 in an army-style lacing pattern or in a bow-tie lacing style. In these lacing methods the lace 544 crosses over itself in the gap 539 between the lace receiving passages 540. The lace 544 is inserted into each of the lace receiving passages 540 at the closed end 466 so that a middle section of the lace 544 extends straight across the gap 539 at the closed end 466. The ends of the lace 544 then pass out of the respective lace receiving passages 540 through a pair of first apertures 550*a* (nearest the closed end 466), cross over each other and are then inserted into the other of the lace receiving passages 540 through the next apertures 550*b*. The lace 544 extends longitudinally through the lace receiving passages 540 to the third apertures 550*c* before again passing out of the respective lace receiving passages 540 through the third apertures 550*c*, crossing over each other and being inserted into the other of the lace receiving passages 540 through the next (fourth) apertures 550*d*. This continues for the full length of the lace receiving passages 540.

Using these lacing methods means that a shorter length of lace 544 is required than with other lacing styles and methods. This is because there are fewer cross-overs along the length of the lace 544. Furthermore, less lace or a shorter length of lace 544 is pulled through the lace receiving passages 540 upon tightening or loosening of the cuff portion 406 of the gloves 402. This makes tightening and loosening the glove 402 easier and quicker, and having a shorter length of lace 544 with fewer cross-overs makes the cuff portion 406 of the glove 402 more comfortable.

It is also possible to evenly tighten the lacing along the full length of the split 464 just by pulling on the free ends of the lace 544. This means that it is not necessary to grab or grip different parts of the lace 544 along the length of the lace to fully tighten the cuff portion 406. This results in a more even tightening along the length of the split 464 and allows another person to easily tighten the gloves 402 on a boxer's hands.

Figure 25:
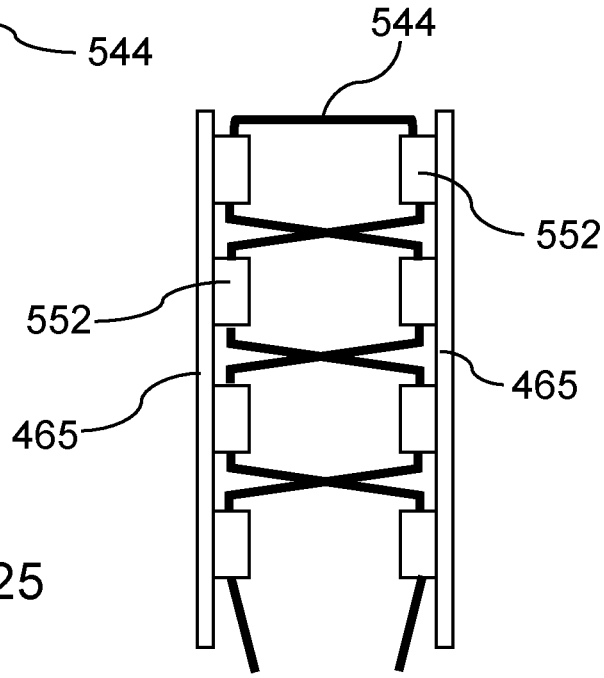
FIG. 25 illustrates a preferred lacing arrangement of a boxing glove.
Figure 26:
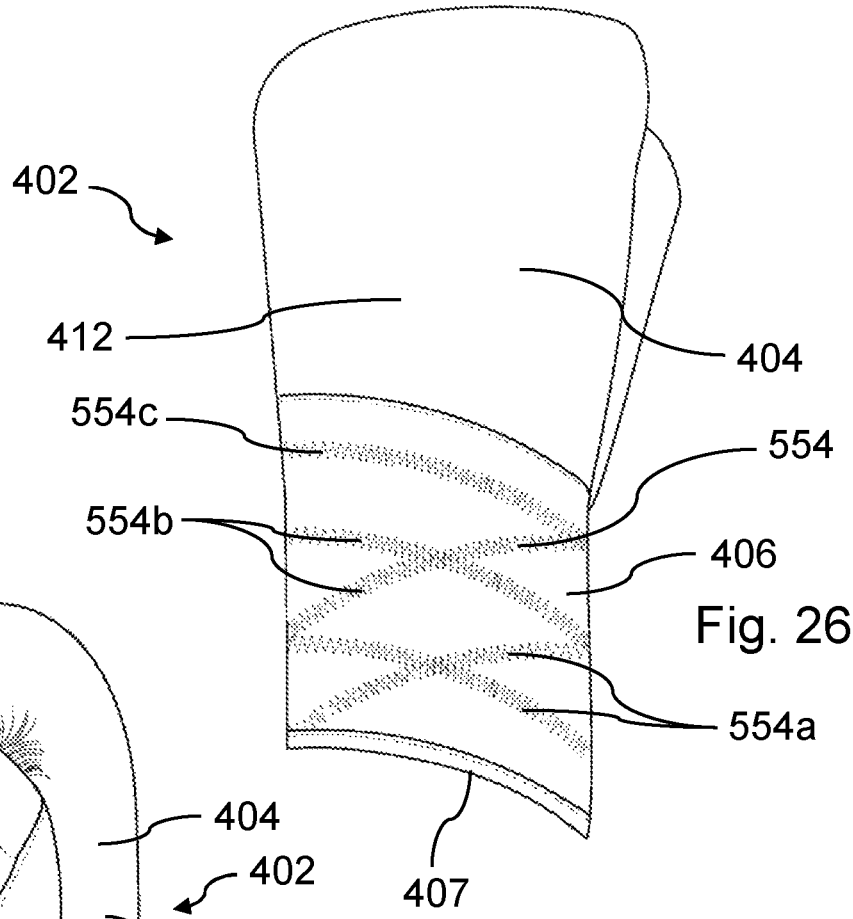
FIG. 26 is a view from a rear side of the boxing glove of FIG. 24.
Figure 27:
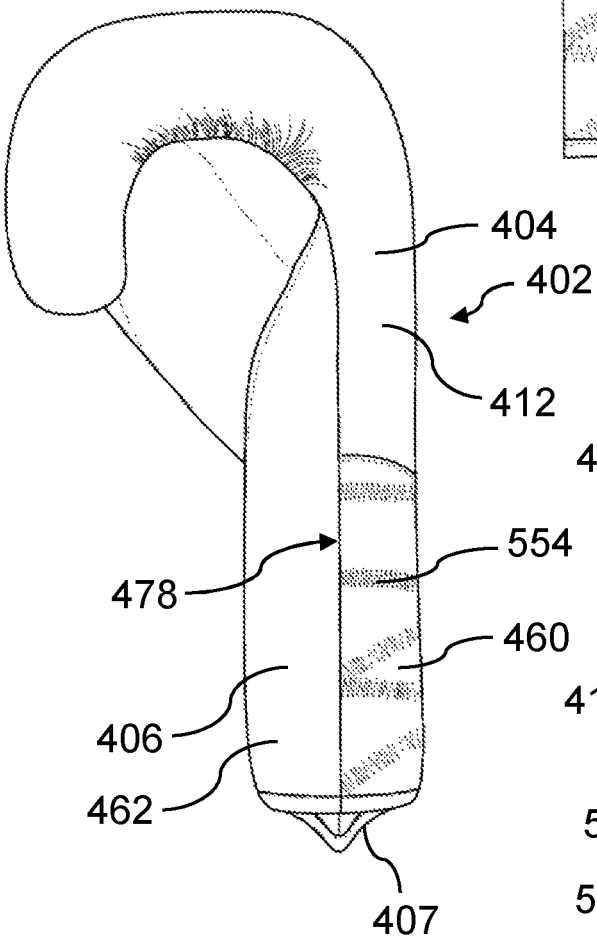
FIG. 27 is a side view from an ulnar side of the boxing glove of FIG. 24.
Figure 28:
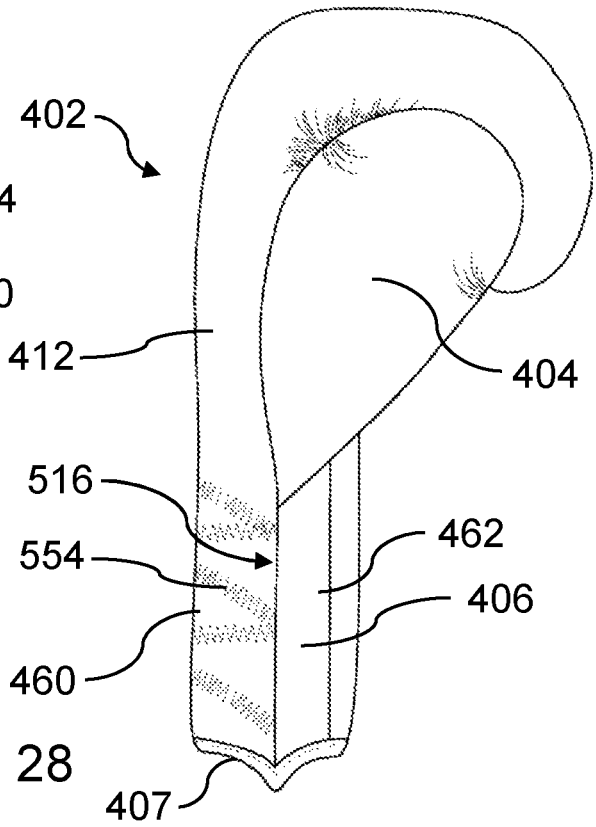
FIG. 28 is a side view from a radial or thumb side of the boxing glove of FIG. 24.

Although in this example the lace receiving passages 540 were formed by elongate tubes 542 including a plurality of slits or apertures 550 along their lengths, in other examples, each of the lace receiving passages 540 may be formed by a plurality of separate or individual lugs 552 extending from the edges 465 of the split 464. This is illustrated in FIG. 25, which also clearly illustrates the army-style lacing or bow-tie lacing method described above. The lugs 552 may be spaced apart along the length of the split 464. Each of the lugs 552 may be in the form of a tubular lug 552, with an axis of each of the tubular lugs 552 extending substantially parallel to the edge 465 of the split 464 to which the lug 552 is attached. A first set of lugs 552 is preferably connected to a first edge 465 of the split 464 and a second set of lugs 552 is preferably connected to a second edge 465 of the split 464. When the lace 544 is in a tightened configuration each of the lugs 552 of the first set of lugs is preferably in contact with a corresponding one of the lugs 552 of the second set of lugs. The advantage of the continuous elongate tube or channel 542 with a plurality of slits or apertures 550 is that the tubes or channels 542 come together to substantially fully close the split 464 when the lace 544 is tightened.

Once the lace 544 has been tightened the free ends of the lace 544 are wrapped around the cuff portion 406 of the boxing glove 402 and then tied. It is desirable if the lace 544 is wrapped evenly around the cuff portion 406 so that the lace 544 does not bunch together in one section of the cuff portion 406 which may be uncomfortable for the wearer or may cause unnecessary pressure on part of the wrist of the wearer.

To guide the user or wearer as to the optimum positioning of the lace as it is wound around the cuff portion 406, the dorsal section 460 of the cuff portion 406 preferably includes guide channels or grooves 554 in the outer surface of the dorsal section 460 for receiving the lace 544. The guide channels or grooves 554 are preferably sufficiently deep that they retain the lace 544 in the channel 554 during wearing of the glove 402. The guide channels or grooves 554 may be defined by stitching which either creates a raised region along edges of each channel 554 or creates a depression in the outer surface of the dorsal section 460 thereby itself creating the channel 554.

In the illustrated example, the dorsal section 460 includes five guide channels 554 that extend across the dorsal section 460 from the outer or ulnar edge 478 of the cuff portion 406 to the inner or radial edge region 516 of the cuff portion 406. A first pair of guide channels 554 extend across the dorsal section 460 proximate the end edge 407. The two guide channels 554*a* of the first pair of guide channels 554 cross over each other approximately midway across the width of the dorsal section 460 so that the first pair of guide channels 554 form an X-shape in the dorsal section 460. A second pair of guide channels 554 extend across the dorsal section 460 between the first pair of guide channels 554 and the back region 412 of the hand portion 404. The two guide channels 554*b* of the second pair of guide channels cross 554 over each other approximately midway across the width of the dorsal section 460 so that the second pair of guide channels 554 also form an X-shape in the dorsal section 460. In this example, a fifth guide channel 554*c* extends across the dorsal section 460 adjacent the back region 212 of the hand portion 404. Each of the guide channels 554 may be curved.

In other examples the dorsal section may include more guide channels extending across the dorsal section from the outer or ulnar edge 478 of the cuff portion 406 to the inner or radial edge region 516 of the cuff portion 406.

In use, a person tightens the lace 544 extending through the lace receiving passages 540 to close the gap 539 of the split 464. The ends of the lace 544 are then wrapped around the cuff portion 406 so that the lace 544 overlies or is seated in the guide channels 554. The ends of the lace 544 may then be knotted or otherwise secured as is known in the art.

In some embodiments the guide channels 554 may be formed by stitching that creates ridges on the surface of the dorsal section 460 of the cuff portion 406. The lace 544 may be held between the rows of stitches or ridges to resist movement of the lace 544 over the surface of the cuff portion 406.

Other modifications and variations not explicitly disclosed above may also be contemplated without departing from the scope of the invention as defined in the appended claims.

The invention claimed is:

1. A boxing glove comprising:

a hand portion for receiving a wearer's hand;

a cuff portion for receiving the wearer's wrist and a part of the wearer's forearm;

a wrist strap attached to and extending from the cuff portion, the wrist strap configured to extend around the cuff portion and including a first securing element;

a cuff strap attached to and extending from the cuff portion, the cuff strap including a second securing element, the first securing element being configured to engage with the second securing element; and a third securing element disposed on a part of the cuff portion, the second securing element being configured to engage with the third securing element; and wherein the wrist strap, the cuff strap, the first securing element, the second securing element and the third securing element are configured such that with: (1) the first securing element engaged with a part of the second securing element, and (2) the cuff strap wrapped around the cuff portion, engaging the second securing element with the third securing element would cause simultaneous moving and tightening of the wrist strap and the cuff strap around the cuff portion.

2. The boxing glove according to claim 1, further comprising a guide element, and wherein the wrist strap is looped around the guide element when the cuff strap is wrapped around the cuff portion.

3. The boxing glove according to claim 2, in which the guide element is a buckle loop through which the wrist strap extends when the first securing element is engaged with the second securing element.

4. The boxing glove according to claim 2, in which the guide element is secured to an end of the wrist strap, and/or in which the guide element is secured to the cuff portion.

5. The boxing glove according to claim 1, in which a length of the cuff portion is defined between the hand portion and an end edge of the cuff portion, and a width of the wrist strap in a direction parallel to the length of the cuff portion is substantially less than the length of the cuff portion.

6. The boxing glove according to claim 5, wherein the width of the wrist strap is less than half the length of the cuff portion.

7. The boxing glove according to claim 5, wherein the wrist strap is adjacent the hand portion.

8. The boxing glove according to claim 5, wherein a width of the cuff strap in a direction parallel to the length of the cuff portion is equal to the length of the cuff portion.

9. The boxing glove according to claim 1, wherein the wrist strap forms a complete loop around the cuff portion when the second securing element is engaged with the third securing element.

10. The boxing glove according to claim 1, wherein the first securing element is disposed at an end of the wrist strap and the second securing element is disposed at an end of the cuff strap.

11. The boxing glove according to claim 1, wherein the third securing element is disposed on a dorsal section of the cuff portion arranged to extend over a back of the wearer's wrist.

12. The boxing glove according to claim 11, wherein the wrist strap extends through a channel between a part of the third securing element and the dorsal section of the cuff portion.

13. The boxing glove according to claim 1, wherein each of the first securing element, second securing element and third securing element comprise one of hook and loop material.

14. The boxing glove according to claim 1, wherein when the second securing element is engaged with the third securing element more than 50% of the wrist strap is covered by the cuff strap.

15. The boxing glove according to claim 1, comprising two or more wrist straps, the wrist straps being spaced along a or the length of the cuff portion defined between the hand portion and an end edge of the cuff portion.

16. The boxing glove according to claim 1, wherein the second securing element includes indicia indicating a distance from an end of the cuff strap adjacent the second securing element.

17. The boxing glove according to claim 1, in which the user's hand is inserted, in use, into the boxing glove in a first direction, and in which a largest dimension of the first securing element in a direction parallel to the first direction is smaller than a smallest dimension of the second securing element in a direction parallel to the first direction.

18. The boxing glove according to claim 1, in which a total surface area of the first securing element is less than a total surface area of the second securing element.

19. A method of putting on a boxing glove comprising:

inserting a hand into a hand portion of the glove such that a cuff portion of the glove extends around a wrist and a part of a forearm;

engaging a first securing element of a wrist strap to a second securing element of a cuff strap, the wrist strap attached to and extending from the cuff portion, the wrist strap configured to extend around the cuff portion;

after engaging the first securing element of the wrist strap to the second securing element of the cuff strap, wrapping the cuff strap around the cuff portion;

after wrapping the cuff strap around the cuff portion, engaging the second securing element to a third securing element disposed on a part of the cuff portion, to simultaneously move and tighten the wrist strap and the cuff strap around the cuff portion.

20. A boxing glove comprising:

a hand portion for receiving a wearer's hand;

a cuff portion for receiving the wearer's wrist and a part of the wearer's forearm;

a wrist strap attached to and extending from the cuff portion, the wrist strap configured to extend around the cuff portion, the wrist strap having opposite first and second surfaces, and including a first securing element on the first surface;

a cuff strap attached to and extending from the cuff portion, the cuff strap including a second securing element, the first securing element being configured to engage with the second securing element; and a third securing element disposed on a part of the cuff portion, the second securing element being configured to engage with the third securing element; and wherein the wrist strap, the cuff strap, the first securing element, the second securing element and the third securing element are configured such that with: (1) the first securing element engaged with a first part of the second securing element, and (2) the cuff strap wrapped around the cuff portion, engaging the second securing element with the third securing element would cause simultaneous tightening of the wrist strap and the cuff strap around the cuff portion, and the second surface of the wrist strap is in contact with but does not engage with the cuff portion.

* * * * *